US011229925B2

(12) United States Patent
Ayotte

(10) Patent No.: US 11,229,925 B2
(45) Date of Patent: Jan. 25, 2022

(54) SYSTEM AND PROCESS FOR CURING A WET COATING APPLIED TO A SUBSTRATE

(71) Applicant: AYOTTE TECHNO-GAZ INC., St-Alphonse Rodriguez (CA)

(72) Inventor: Daniel Ayotte, St-Alphonse Rodriguez (CA)

(73) Assignee: AYOTTE TECHNO-GAZ INC., Joliette (CA)

( * ) Notice: Subject to any disclaimer, the term of this patent is extended or adjusted under 35 U.S.C. 154(b) by 0 days.

(21) Appl. No.: 17/199,842

(22) Filed: Mar. 12, 2021

(65) Prior Publication Data

US 2021/0283649 A1 Sep. 16, 2021

Related U.S. Application Data

(60) Provisional application No. 62/988,701, filed on Mar. 12, 2020.

(51) Int. Cl.
*F26B 3/34* (2006.01)
*B05D 3/02* (2006.01)
(Continued)

(52) U.S. Cl.
CPC ..... *B05D 3/0263* (2013.01); *F26B 3/30* (2013.01); *F26B 3/305* (2013.01); *F26B 15/12* (2013.01);
(Continued)

(58) Field of Classification Search
CPC ..... B05D 3/0263; F26B 3/305; F26B 3/30; F26B 21/04; F26B 21/003; F26B 21/10; F26B 15/12; F26B 2210/16
(Continued)

(56) References Cited

U.S. PATENT DOCUMENTS 3,678,595 A 7/1972 Fagerstrom
4,907,533 A 3/1990 Nelson et al.
(Continued)

FOREIGN PATENT DOCUMENTS

EP 0369477 B1 9/1993

OTHER PUBLICATIONS

Belt Conveyor Ovens : https://www.fostoriaprocessequipment.com/belt-conveyor-oven.html.
(Continued)

*Primary Examiner* — John P McCormack
(74) *Attorney, Agent, or Firm* — Carlson, Gaskey & Olds, P.C.

(57) ABSTRACT

Systems and processes for curing a wet coating of a coated substrate are disclosed. The system includes a ventilation system and a curing room configured to receive the coated substrate being displaced along a displacement axis and includes at least an upstream curing section and a downstream curing section. The upstream curing section includes an upstream catalytic infrared heating system for producing an upstream infrared radiation at an upstream radiation intensity to heat and partially cure the wet coating while the coated substrate is being displaced through the upstream curing section. On the other hand, the downstream curing section includes a downstream catalytic infrared heating system for producing a downstream infrared radiation at a downstream radiation intensity, being lower than the upstream radiation intensity, to further cure the wet coating while the coated substrate is being displaced through the downstream curing section for producing a cured coating.

19 Claims, 11 Drawing Sheets

(51) Int. Cl.

| | |
|---|---|
| ***F26B 15/12*** | (2006.01) |
| ***F26B 3/30*** | (2006.01) |
| ***F26B 21/00*** | (2006.01) |
| ***F26B 21/04*** | (2006.01) |
| ***F26B 21/10*** | (2006.01) |

(52) U.S. Cl.
CPC ..... *F26B 21/003* (2013.01); *F26B 21/04* (2013.01); *F26B 21/10* (2013.01); *F26B 2210/16* (2013.01)

(58) Field of Classification Search
USPC ..... 34/266, 514, 589, 636
See application file for complete search history.

(56) References Cited

U.S. PATENT DOCUMENTS

| | | | | |
|---|---|---|---|---|
| 6,291,027 | B1 * | 9/2001 | Emch | B05D 3/0209 427/379 |
| 7,011,869 | B2 | 3/2006 | Emch | |
| 7,488,518 | B2 | 2/2009 | Ortlieb et al. | |
| 7,800,023 | B2 * | 9/2010 | Burtea | A21B 1/02 219/411 |
| 8,367,978 | B2 | 2/2013 | Williams | |
| 8,513,572 | B2 | 8/2013 | Schumacher et al. | |
| 8,865,058 | B2 | 10/2014 | Seals et al. | |
| 9,841,232 | B2 | 12/2017 | Chapman | |
| 10,737,290 | B2 | 8/2020 | Chapman | |
| 2002/0148137 | A1 | 10/2002 | Eisenacher et al. | |
| 2004/0123491 | A1 * | 7/2004 | Schneider | F26B 3/305 34/666 |
| 2008/0184589 | A1 * | 8/2008 | Shivvers | F26B 3/08 34/504 |
| 2011/0154686 | A1 * | 6/2011 | Tippmann | F26B 25/12 34/475 |
| 2012/0294595 | A1 * | 11/2012 | Veltrop | A21B 2/00 392/416 |
| 2015/0034248 | A1 * | 2/2015 | Chapman | F26B 3/305 156/359 |
| 2019/0234686 | A1 * | 8/2019 | Brodie | F26B 21/004 |
| 2019/0389434 | A1 * | 12/2019 | Moll | F26B 21/10 |

OTHER PUBLICATIONS

Flash Off Drying Oven : https://www.process-heating.com/articles/91789-specifying-wood-drying-ovens.
Industrial Infrared Heaters : https://www.quartzinfrared.com/References/applications_of_electric_infrared_heating.pdf.
Wood Coating Drying Ovens : http://www.infratrol.com/featured_products/Wood-Coating-Drying-Ovens.html.

* cited by examiner

SYSTEM AND PROCESS FOR CURING A WET COATING APPLIED TO A SUBSTRATE

PRIOR APPLICATION

The present application claims priority from U.S. provisional patent application No. 62/988,701, filed on Mar. 12, 2020, and entitled "SYSTEM AND PROCESS FOR CURING A WET COATING APPLIED TO A WOOD SUBSTRATE", the disclosure of which being hereby incorporated herein by reference in its entirety.

TECHNICAL FIELD

The technical field relates to systems and processes for curing a film of wet coating, such as a water-based coating or a solvent-based coating, applied to a substrate, such as a wood substrate. More particularly, the technical field relates to systems and processes for curing a film of wet coating applied to a substrate using gas catalyst infrared radiation systems.

BACKGROUND

It is known to use electric infrared radiation to accelerate curing of a film of coating or powder, such as paint, applied to a substrate, such as to a metallic substrate. Infrared energy is a form of radiation, which falls between visible light and microwaves in the electromagnetic spectrum. Like other forms of electromagnetic energy, infrared travels in waves and there is a known relationship between the wavelength, frequency and energy level. That is, the energy (i.e., the temperature) increases as the wavelength decreases.

Unlike convection, which first heats air to transmit energy to the substrate, infrared energy can be absorbed directly by the coating or powder, which prevents the substrate from being damaged by reaching high temperatures. Gas catalytic infrared (IR) systems can deliver medium to long wave radiation so as to cure wet coatings applied to substrate, for instance wood substrate. Indeed, a gas catalytic IR heater is a flameless heat source that uses chemical reactions to break down molecules and produce heat. In the presence of a catalyst, catalytic combustion occurs when a combustible gas (e.g., a gaseous hydrocarbon such as natural gas, propane, butane, etc.), in the presence of an oxidizer gas (e.g., oxygen), produces carbon dioxide, water, and heat. The ignition temperature of the combustible gas occurs at substantially low temperatures. Therefore, no flame is involved in the combustion process and infrared waves are created, producing radiant heat.

There are still a number of challenges in using gas catalyst infrared radiation systems for curing films of wet coating applied to substrates.

In view of the above, there is a need for a system and a process for curing a wet coating applied to a substrate which would be able to overcome or at least reduce some of the above-discussed prior art concerns.

BRIEF SUMMARY

It is therefore an aim of the present invention to address the above-mentioned issues.

According to a general aspect, there is provided a system for curing a wet coating of a coated substrate, the system comprising: a curing room configured to receive the coated substrate being displaced along a displacement axis, the curing room being dividable along the displacement axis into at least: an upstream curing section comprising an upstream catalytic infrared heating system for producing an upstream infrared radiation at an upstream radiation intensity to partially cure the wet coating while the coated substrate is being displaced through the upstream curing section along the displacement axis; and a downstream curing section comprising a downstream catalytic infrared heating system for producing a downstream infrared radiation at a downstream radiation intensity, being lower than the upstream radiation intensity, to further cure the wet coating while the coated substrate is being displaced through the downstream curing section along the displacement axis for producing a cured coating; and a ventilation system having: an inlet and an outlet both being at one of the upstream and downstream curing sections; wherein the ventilation system uniformizes in the corresponding one of the upstream and downstream curing sections a heated air stream produced therein and/or recirculates from one of the upstream and downstream curing sections towards the other one of the upstream and downstream curing sections the heated air stream produced in said one of the upstream and downstream curing sections.

According to another general aspect, there is provided a system for curing a wet coating of a coated substrate, the system comprising: a curing room having a curing room inlet and a curing room outlet spaced apart from each other and configured to receive the coated substrate being displaced along a displacement axis between the curing room inlet and the curing room outlet, the curing room being dividable along the displacement axis into: an upstream curing section comprising an upstream catalytic infrared heating system for producing an upstream infrared radiation at an upstream radiation intensity to partially cure the wet coating while the coated substrate is being displaced through the upstream curing section along the displacement axis; and a downstream curing section comprising a downstream catalytic infrared heating system for producing a downstream infrared radiation at a downstream radiation intensity, being lower than the upstream radiation intensity, to further cure the wet coating while the coated substrate is being displaced through the downstream curing section along the displacement axis for producing a cured coating; a pre-curing room upstream the curing room and comprising a pre-curing room outlet being fluidly connected to the curing room inlet in an airtight manner; and a ventilation system comprising a fluid circulation duct having: an inlet at the pre-curing room; and an outlet at the curing room outlet or in the vicinity thereof; wherein the ventilation system at least one of lowers an inner pressure of the pre-curing room and cools the cured coated substrate at the curing room outlet.

In some embodiments, the curing room further comprises a curing room inlet and a curing room outlet spaced apart from each other, and a conveyor for conveying the coated substrate through the curing room from the curing room inlet towards the curing room outlet along the displacement axis.

In some embodiments, the upstream infrared radiation has a wavelength of between about 5 μm and about 10 μm.

In some embodiments, the downstream infrared radiation has a wavelength of between about 1 μm and about 7 μm.

In some embodiments, the upstream catalytic infrared heating system uses natural gas as a combustible, the upstream radiation intensity being between about 40,000 btu and about 70,000 btu.

In some embodiments, the downstream catalytic infrared heating system uses natural gas as a combustible, the downstream radiation intensity being between about 24,000 btu and about 42,000 btu.

In some embodiments, the upstream curing section of the curing room has an upstream surface area and the upstream catalytic infrared heating system comprises an upstream emitting surface, the upstream emitting surface being between about 30% and about 100% of the upstream surface area.

In some embodiments, the downstream curing section of the curing room has a downstream surface area and the downstream catalytic infrared heating system comprises a downstream emitting surface, the downstream emitting surface being between about 30% and about 100% of the downstream surface area.

In some embodiments, the system further comprises a heating system controller assembly operatively coupled to at least one of the upstream catalytic infrared heating system and the downstream catalytic infrared heating system to control the corresponding one of the upstream and downstream radiation intensities.

In some embodiments, the system further comprises an upstream temperature sensing device in the upstream curing section to measure an upstream temperature of the wet coating being displaced through the upstream curing section.

In some embodiments, the upstream temperature sensing device is operatively coupled to the heating system controller assembly.

In some embodiments, the system further comprises a downstream temperature sensing device in the downstream curing section to measure a downstream temperature of the wet coating being displaced through the downstream curing section.

In some embodiments, the downstream temperature sensing device is operatively coupled to the heating system controller assembly.

In some embodiments, the system further comprises a curing system controller operatively coupled to the heating system controller assembly and the upstream and downstream temperature sensing devices for controlling the heating system controller assembly relative to measured values of the upstream and downstream temperatures.

In some embodiments, at least one of the upstream and downstream catalytic infrared heating systems comprises a plurality of spaced apart gas catalytic infrared heaters.

In some embodiments, the ventilation system comprises at least one intrasection recirculation duct having an inlet and an outlet both at one of the upstream and downstream curing sections for uniformizing the heated air stream produced in the corresponding one of the upstream and downstream curing sections.

In some embodiments, the ventilation system comprises at least one intersection recirculation duct having an inlet at the downstream curing section and an outlet at the upstream curing section for recirculating the heated air stream produced in the downstream curing section towards the upstream curing section.

In some embodiments, the ventilation system comprises an exhaust duct having an inlet at one of the upstream and downstream curing sections and an outlet for expelling air out of the curing room.

In some embodiments, the system further comprises a pre-curing room upstream the curing room and comprising a pre-curing room outlet being fluidly connected to the curing room inlet in an airtight manner.

In some embodiments, the pre-curing room comprises an air stream inlet for ambient air to flow therethrough and a filtering system at the air stream inlet to filter the ambient air.

In some embodiments, a pressure within the pre-curing room is substantially null.

In some embodiments, the ventilation system comprises a cooling duct comprising a cooling duct inlet at the pre-curing room and a cooling duct outlet at the curing room outlet or in the vicinity thereof for cooling the cured coated substrate.

In some embodiments, the system further comprises a wet coating spraying or brushing equipment upstream the pre-curing room, the pre-curing room, the curing room and the wet coating spraying or brushing equipment being configured in an ambient airtight manner so that the coated substrate can be provided to the curing room with no contact with the ambient air surrounding the curing room.

In some embodiments, the curing room is further dividable along the displacement axis into an intermediate curing section arranged between the upstream curing section and the downstream curing section, the intermediate curing section comprising an intermediate catalytic infrared heating system for producing an intermediate infrared radiation at an intermediate radiation intensity, being lower than the upstream radiation intensity and higher than the downstream radiation intensity, to partially cure the wet coating while the coated substrate is being displaced through the intermediate curing section.

In some embodiments, the intermediate curing section is directly connected to at least one of the upstream and downstream curing sections.

In some embodiments, the intermediate infrared radiation has a wavelength of between about 1 μm and about 7 μm.

In some embodiments, the intermediate catalytic infrared heating system uses natural gas as a combustible, the intermediate radiation intensity being between about 28,000 btu and about 49,000 btu.

In some embodiments, the intermediate curing section of the curing room has an intermediate surface area and the intermediate catalytic infrared heating system comprises an intermediate emitting surface, the intermediate emitting surface being between about 30% and about 100% of the intermediate surface area.

In some embodiments, the intermediate curing section is at least partially separated from at least one of the upstream and downstream curing sections.

In some embodiments, the curing room further comprises a first separator to partially separate an upper portion of the upstream curing section from an upper portion of the intermediate curing section.

In some embodiments, the curing room further comprises a second separator to partially separate the upper portion of the intermediate curing section from an upper portion of the downstream curing section.

In some embodiments, the at least one intersection recirculation duct comprises a first intersection recirculation duct having an inlet at the downstream curing section and an outlet at the intermediate curing section for recirculating the heated air stream produced in the downstream curing section towards the intermediate curing section; and a second intersection recirculation duct having an inlet at the intermediate curing section and an outlet at the upstream curing section for recirculating a heated air stream produced in the intermediate curing section towards the upstream curing section.

In some embodiments, an inner volume of the curing room is between about 5 $m^3$ and about 1000 $m^3$.

According to another general aspect, there is provided a process for curing a wet coating of a coated substrate, the process comprising: displacing the coated substrate in a curing room along a displacement axis through an upstream curing section and then through a downstream curing section; in the upstream curing section, producing an upstream infrared radiation at an upstream radiation intensity using an upstream catalytic infrared heating system to partially cure the wet coating while the coated substrate is being displaced through the upstream curing section; in the downstream curing section, producing a downstream infrared radiation at a downstream radiation intensity, being lower than the upstream radiation intensity, using a downstream catalytic infrared heating system to further cure the wet coating while the coated substrate is being displaced through the downstream curing section; and uniformizing in at least one of the upstream and downstream curing sections a heated air stream produced therein and/or recirculating from one of the upstream and downstream curing sections towards the other one of the upstream and downstream curing sections the heated air stream produced in said one of the upstream and downstream curing sections.

In some embodiments, the process further comprises conveying the coated substrate through the curing room along the displacement axis from a curing room inlet towards a curing room outlet.

In some embodiments, the coated substrate is further displaced through an intermediate curing section of the curing room after being displaced through the upstream curing section and before being displaced through the downstream curing section.

In some embodiments, the process further comprises, in the intermediate curing section, producing an intermediate infrared radiation at an intermediate radiation intensity, being lower than the upstream radiation intensity and higher than the downstream radiation intensity, using an intermediate catalytic infrared heating system to further heat and partially cure the wet coating while the coated substrate is being displaced through the intermediate curing section, a heated air stream being produced in the intermediate curing section.

In some embodiments, a residence time of the coated substrate in the curing room is less than about 15 minutes.

In some embodiments, in the upstream curing section, the wet coating is heated from an initial temperature to an upstream temperature comprised between about 40° C. and about 80° C.

In some embodiments, in the intermediate curing section, the wet coating is heated from the upstream temperature to an intermediate temperature comprised between about 50° C. and about 80° C.

In some embodiments, in the downstream curing section, the wet coating is heated from the intermediate temperature to a downstream temperature comprised between about 55° C. and about 85° C.

In some embodiments, the heated air stream produced in the downstream curing section is recirculated towards the intermediate curing section.

In some embodiments, a water content of the heated air stream in the downstream curing section is between about 30% v/v and about 60% v/v.

In some embodiments, the heated air stream produced in the intermediate curing section is recirculated towards the upstream curing section.

In some embodiments, a water content of the intermediate heated air stream is between about 40% v/v and about 70% v/v.

In some embodiments, a water content of the heated air stream produced in the upstream curing section is between about 50% v/v and about 80% v/v.

In some embodiments, the water content of the heated air stream produced in the upstream curing section is higher than the water content of at least one of the heated air streams produced in the intermediate and downstream curing sections.

In some embodiments, an airflow rate of the heated air stream produced in the upstream curing section is between about 600 cfm and about 1800 cfm.

In some embodiments, an airflow rate of the heated air stream produced in the intermediate curing section is between about 200 cfm and about 1000 cfm.

In some embodiments, an airflow of the heated air stream produced in the downstream curing section is between about 100 cfm and about 500 cfm.

In some embodiments, a thickness of the wet coating is between about 1 mm and about 6 mm.

In some embodiments, once the coated substrate has passed through the upstream curing section, a thickness of the cured coating is between about 50 and about 99%.

In some embodiments, once the coated substrate has passed through the intermediate curing section, the thickness of the cured coating is between about 51% and about 100%.

In some embodiments, the coated substrate is conveyed through the curing room at a speed of between about 0.50 m/s and about 3 m/s.

In some embodiments, the coated substrate is conveyed through the curing room in a substantially horizontal orientation.

In some embodiments, a plurality of spaced apart coated substrates are conveyed, one after the other, through the curing room along the displacement axis.

In some embodiments, at least one of the upstream, intermediate and downstream infrared radiations is substantially perpendicular to the coated substrate.

In some embodiments, the wet coating is a water-based coating.

In some embodiments, the wet coating is heated and cured from a lower layer of the wet coating towards an upper layer of the wet coating.

In some embodiments, the process further comprises providing a pre-curing room upstream the curing room; and fluidly connecting a pre-curing room outlet to the curing room inlet in an airtight manner airtight.

In some embodiments, the process further comprises lowering an inner pressure of the pre-curing room.

In some embodiments, the process further comprises filtering an ambient air prior it flows through the curing room via the pre-curing room.

In some embodiments, the process further comprises circulating a cool air from the pre-curing room directly towards the curing room outlet to cool the cured coated substrate.

In some embodiments, a pressure gradient of the curing room is substantially null.

According to another general aspect, there is provided a system for curing a wet coating of a coated wood substrate, the system comprising: a curing room configured to receive the wood substrate being displaced along a displacement axis and comprising: an upstream curing section comprising an upstream gas catalytic infrared heating system for producing an upstream infrared radiation at an upstream radiation intensity to partially cure the wet coating while the coated wood substrate is being displaced through the upstream curing section; and a downstream curing section comprising a downstream catalytic infrared heating system for producing a downstream infrared radiation at a downstream radiation intensity, being lower than the upstream radiation intensity, to further cure the wet coating while the coated wood substrate is being displaced through the downstream curing section for producing a cured coating.

According to another general aspect, there is provided a process for curing a wet coating of a coated wood substrate, the process comprising: displacing the coated wood substrate in a curing room along a displacement axis through an upstream curing section and then through a downstream curing section; in the upstream curing section, producing an upstream infrared radiation at an upstream radiation intensity using an upstream gas catalytic infrared heating system to partially cure the wet coating while the coated wood substrate is being displaced through the upstream curing section; and in the downstream curing section, producing a downstream infrared radiation at a downstream radiation intensity, being lower than the upstream radiation intensity, using a downstream gas catalytic infrared heating system to further cure the wet coating while the coated wood substrate is being displaced through the downstream curing section.

DETAILED DESCRIPTION

Figure 1:
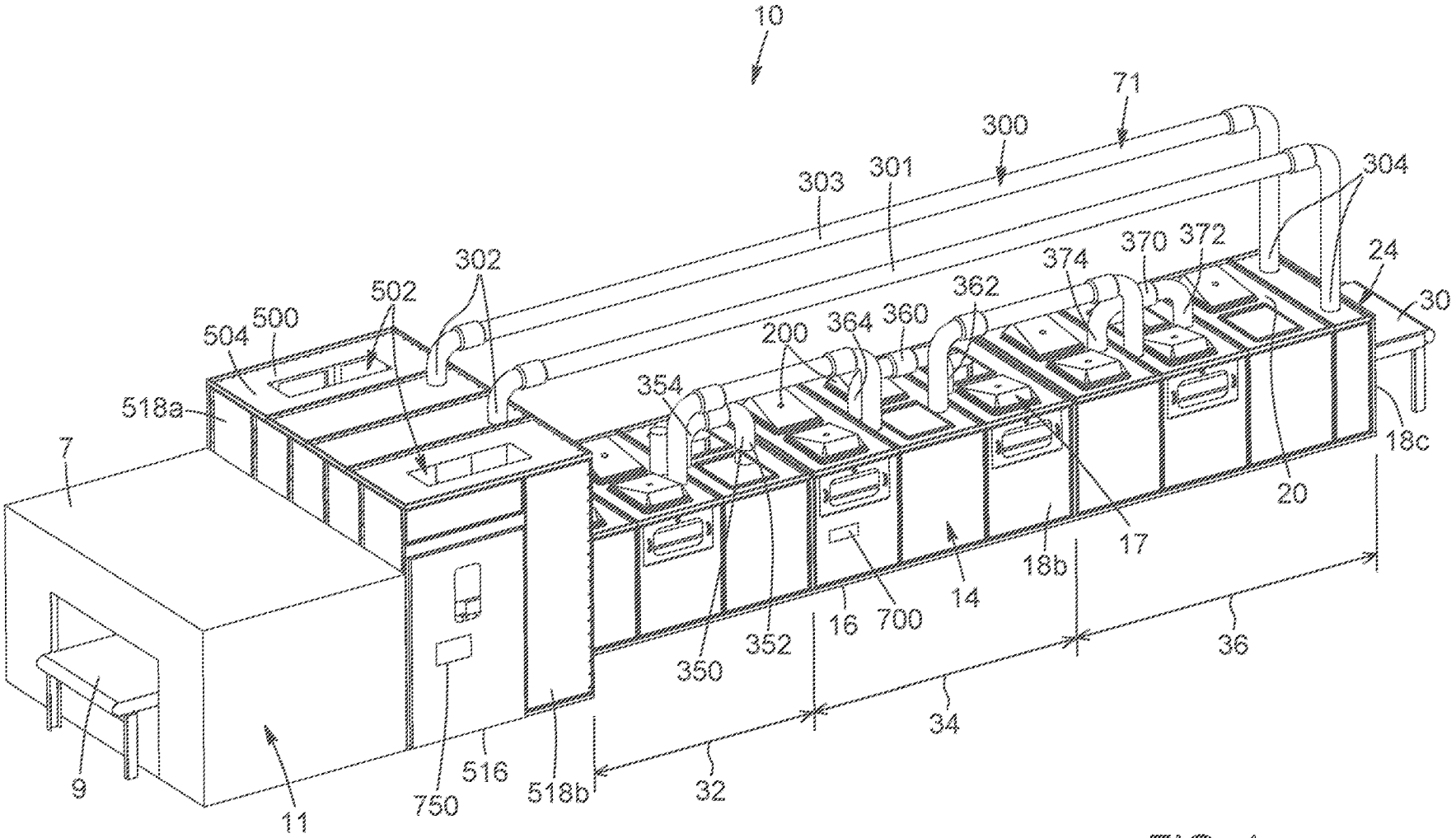
FIG. 1 is a first top perspective view of a system for curing a wet coating applied to a substrate in accordance with a first embodiment, the system comprising a curing room with a plurality of gas catalytic infrared heaters and a pre-curing room being positioned downstream from a wet coating spraying or brushing equipment.

The systems and processes described herein allow for curing a film of wet coating applied to a substrate, for instance a wood substrate, by using a gas catalytic infrared (IR) system. The wood substrate can include a natural wood substrate, such as maple, oak, walnut, pine, spruce, fir, cedar, juniper, redwood, yew, or any other hard wood or soft wood substrate, or alternatively, an engineered wood substrate, such as a high-density fiber board, a medium-density fiber board or any other engineered wood substrate. The wet coating can be a water-based coating or a solvent-based coating. In one scenario, the wet coating can be paint, which can include water, but also resins, pigments, additives, any other constituents or any combination thereof.

More particularly, the systems and processes described herein allow for curing a film of paint that has been applied to a wooden cabinet door. It is however noted that any other wooden furniture or wooden component (e.g., beam, handrail, countertop, molding, etc.) that has been coated with a film of paint can be dried and cured using the systems and processes described herein. Coating applied to substrates being at least partially made of material different from wood could also be at least partially cured by the systems and processes described herein.

In one implementation, the system can include a curing room for receiving the coated substrate, for instance the coated wood substrate, and a gas catalytic IR system, provided in the curing room, to cure the wet coating using IR heat. The gas catalytic IR system produces medium to long IR waves, which allow the IR radiation to be evenly absorbed by the wet coating, rather than by the substrate itself, as it can be the case when using an electric IR system, for example. The curing room can be dividable along a longitudinal axis thereof into a plurality of curing sections and can for instance include an upstream curing section and a downstream curing section, and the system can further include a conveyor, for conveying the coated wood substrate through the upstream curing section and then through the downstream curing section of the curing room.

In the following description, the terms upstream and downstream should be understood with respect to a displacement of the coated substrate within the curing room. It is further understood that the upstream and downstream curing sections are not necessarily directly adjacent to each other and can be separated from each other by one or more additional intermediate curing sections forming at least partially the curing room. In other words, in the present disclosure, the upstream and downstream curing sections of the curing room can either be directly or indirectly in fluid communication with each other.

In some implementations, other equipment can be used to displace the coated wood substrate through the plurality of curing sections of the curing room. Optionally, the system can be positioned downstream from a paint spraying or brushing automated equipment so as to cure the wet coating (or powder) just after it has been applied to the wood substrate. In one scenario, the system can further include a pre-curing room (or pre-drying room), which can be configured in a sealed engagement (i.e., in a fluid tight manner) with a paint spraying or brushing room which can receive the spraying or brushing equipment and/or with the curing room. For example, the pre-curing room can include an air stream inlet for allowing ambient air to flow therethrough so as to circulate into the drying—or curing—room from the upstream curing section towards the downstream curing section. In one implementation, as detailed below, the pre-curing room can include one or more air filtering elements at the air stream inlet so that ambient air can be filtered prior to be received within the curing room.

The upstream curing section can include one or more upstream gas catalytic IR heater(s) to heat the wet coating using an upstream IR radiation, at an upstream IR radiation intensity (at an upstream IR wavelength), to partially cure the film of wet coating, bottom up or inside out (i.e., from a lower layer of the wet coating upwardly towards an upper layer of the wet coating). On the other hand, the downstream curing section can include one or more downstream gas catalytic IR heater(s) to further heat the remaining wet coating, bottom up, using a downstream IR radiation, at a downstream IR radiation intensity (at a downstream IR wavelength), being lower than the upstream IR radiation intensity (being lower than the upstream IR wavelength), to fully cure the film of wet coating, so as to produce a cured coated wood substrate.

The upstream IR radiation being produced by the upstream gas catalytic IR heater(s) directed towards the exposed wet coating can thus be evenly absorbed, at least in part, by the wet coating applied to the substrate (for instance the wood substrate) being displaced through the upstream curing section. The wet coating can thus be cured, from a lower layer of the wet coating towards an upper layer of the wet coating. The water can therefore be expelled from the wet coating, under excitement of the water molecules (rather than by evaporation), in the upstream curing section of the curing room, increasing a temperature and/or a humidity rate, of an air stream produced in the upstream curing section. It is noted that the wavelength of the upstream IR radiation produced by the upstream IR radiation heater(s) needs to be such that the film of wet coating is cured bottom up (i.e., inside out). Indeed, if the top layer of the wet coating is cured first, the water can remain trapped inside the film of coating. The trapped water can thus burst out, causing little craters or poppings (i.e., the obtained coated wood substrate may thus need to be polished or scrapped). Once the partially coated wood substrate has reached the downstream curing section of the curing room, the downstream IR radiation produced by the downstream gas catalytic IR heater(s) directed towards the remaining wet coating can thus be evenly absorbed, at least in part, by the wet coating, so it can be fully cured, inside out. The water remaining in the wet coating can also be expelled therefrom in the downstream curing section of the curing room.

In one implementation, the system can further include a ventilation system for directing the upstream heated air stream (with a high content of water) from the upstream curing section towards the downstream curing section or vice versa. The curing room can further include an intermediate curing section. The intermediate curing section can include one or more intermediate gas catalytic IR heater(s) to further cure the remaining wet coating using an intermediate IR radiation, at an intermediate radiation intensity, being lower than the upstream radiation intensity, but higher than the downstream radiation intensity, to further cure the remaining film of wet coating before the coated wood substrate travels through the downstream curing section.

System for Curing a Wet Coating of a Coated Substrate (or Coated Support)

Figure 8:
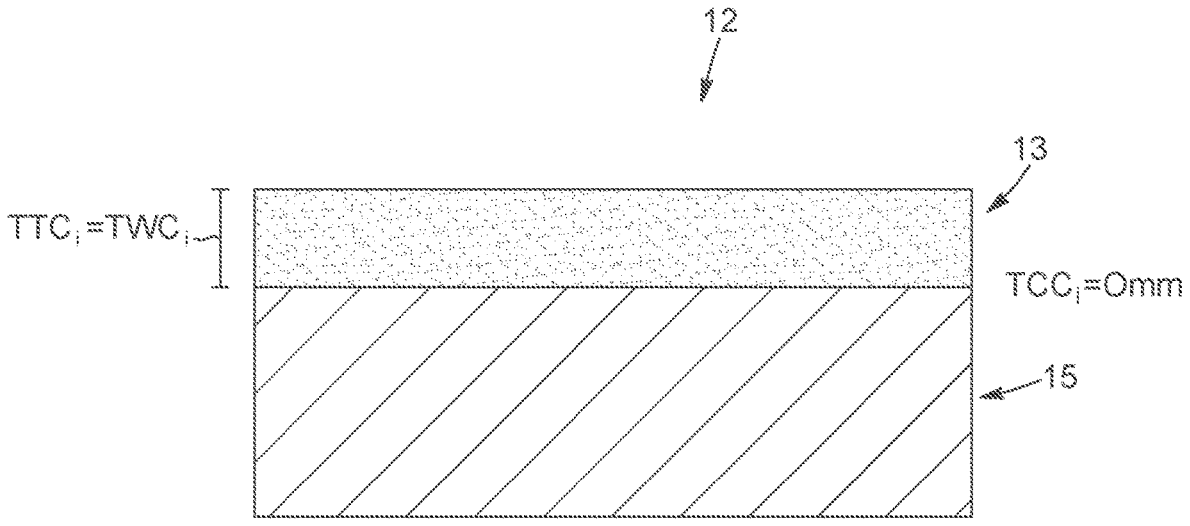
FIG. 8 is a schematic cross-section view of a coated substrate prior it has entered the curing room of the system of FIG. 1.

Referring now more particularly to FIGS. 1 to 6, in one implementation, there is provided a curing system 10 for curing a coated wood substrate 12 (or coated support 12) (FIG. 6) using IR radiation produced by a gas catalytic IR system 17. The system 10 allows to fully cure, inside out, the film of wet coating 13 that has been applied to the wood substrate 15 (FIG. 8). In one scenario, the system 10 can be positioned downstream (either directly or indirectly) from a wet coating spraying or brushing equipment 11, as shown in FIG. 1. In operation, the wood substrate 15 can pass through the equipment 11 via a painting room conveyor 9, and the wet coating 13 can be applied thereto. In another scenario, the wet coating 13 can be applied manually to the wood substrate 15, using conventional spraying or brushing techniques for example, to produce the coated wood substrate 12, prior it can be supplied to the system 10. According to both scenarios, it is noted that the system 10 can alternatively be located remotely from the spraying or brushing location.

As best shown in FIG. 8, in one implementation, the wet coating 13 applied to the wood substrate 15 can have a thickness TWCi of between about 1 mm and about 6 mm, of between about 2 mm and about 5 mm, or of between about 3 mm and about 4 mm, depending on the nature of the wet coating 13, the nature of the wood substrate 15 (or support 15) to be coated, the desired end results, etc. The wood substrate 15 can have a top surface, a bottom surface, and side walls which join the top surface and the bottom surface. In the embodiment shown, the wood substrate is substantially parallelepipedal but other shapes could be conceived. It is noted that in one scenario, all the external surfaces (i.e., top, bottom and walls) can be painted. In another scenario, only one surface, or only some surfaces thereof, can be painted prior the coated wood substrate 12 is supplied to the system 10.

Curing Room (Drying Room)

Figure 5:
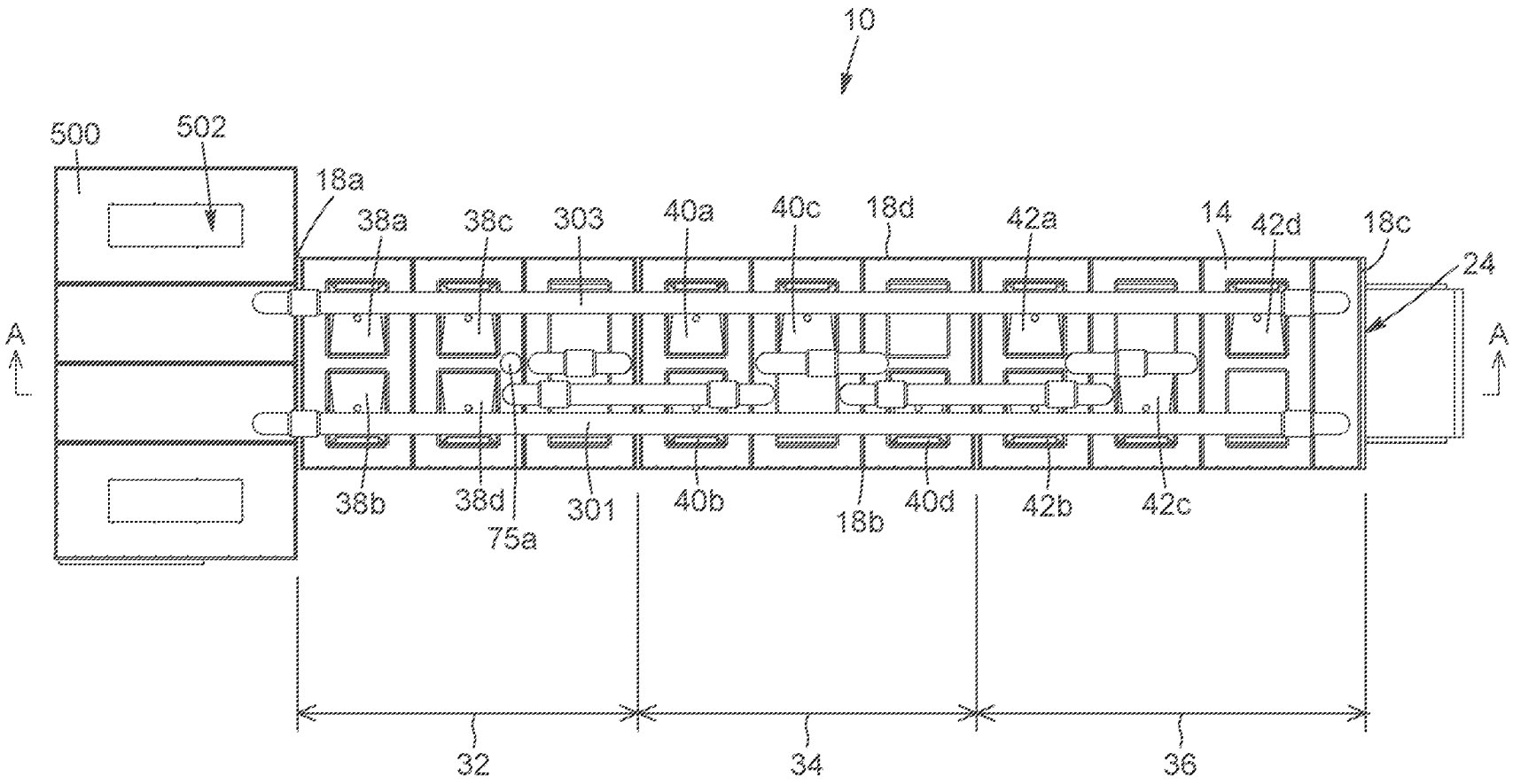
FIG. 5 is a top elevational view of the system of FIG. 1.
Figure 6:
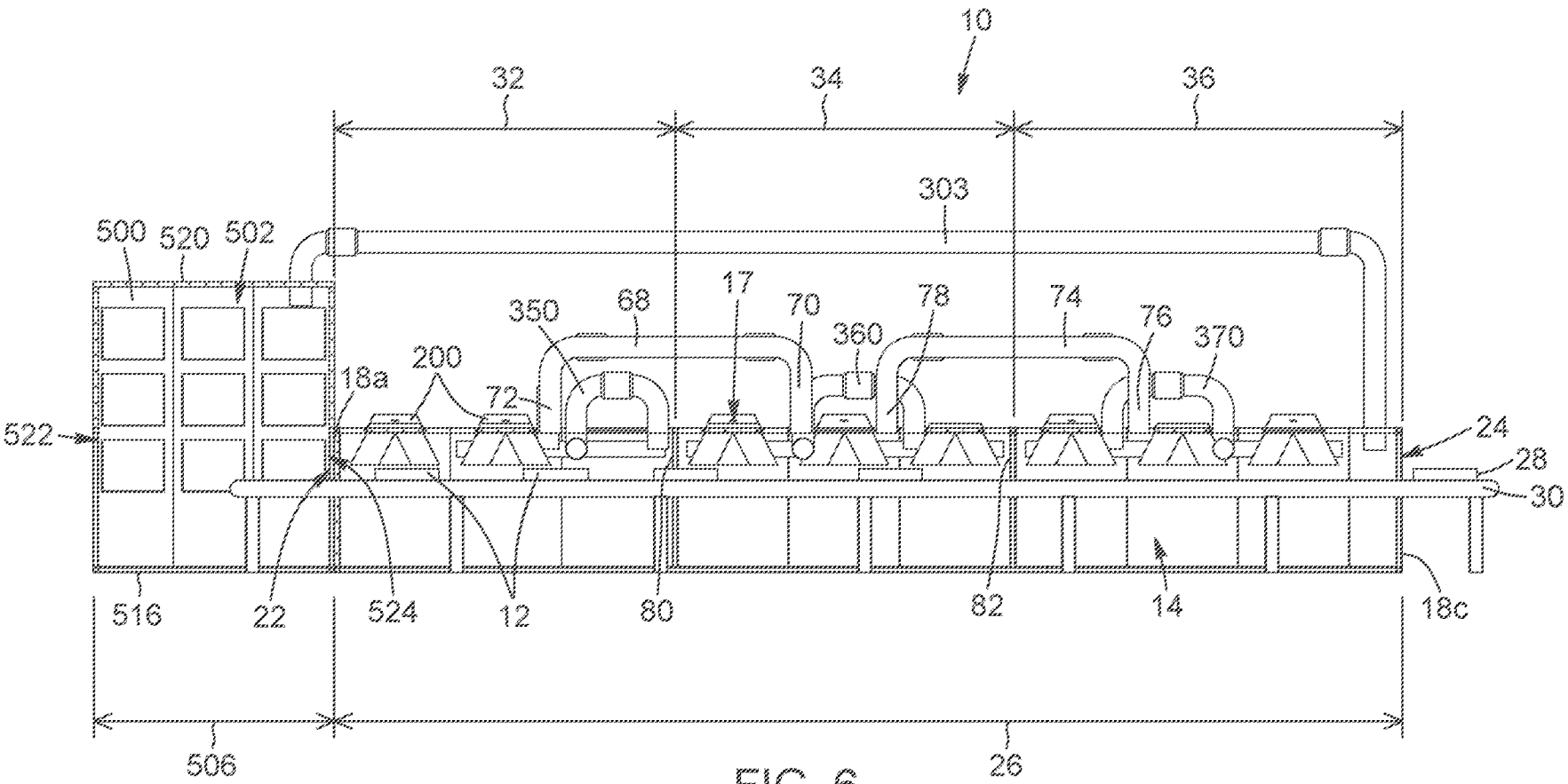
FIG. 6 is a cross-section view of the system of FIG. 5 taken along lines A-A thereof.

Referring back to the implementation of FIGS. 1 to 6, the system 10 includes a curing room 14 (or drying room 14) for receiving the coated wood substrate 12 therein. The curing room 14 includes a floor 16, which has a floor periphery, and walls 18*a*, 18*b*, 18*c*, 18*d*, which substantially upwardly extend from the floor 16 at the floor periphery thereof. The curing room 14 further includes a ceiling 20, a curing room inlet 22, which can be formed in the wall 18*a* for example, as well as a curing room outlet 24, which can be formed in the wall 18*c* for example. In the implementation of FIG. 6, the curing room outlet 24 is located opposite to the curing room inlet 22, so that the coated wood substrate 12 can be displaced through the curing room 14, from the curing room inlet 22 towards the curing room outlet 24, along a displacement axis 26 (for instance a centerline) of the curing room 14 to allow continuous curing operations. In another scenario, the coated wood substrate 12 can be introduced in the curing room 14 via a room aperture (not shown), and the cured coated wood substrate 28 can be removed from the curing room 14 via that same room aperture to allow batch curing operations, for example. The curing room 14 can take any shape, size or configuration, as long as it allows the wet coating 13 to be substantially fully cured once it has travelled through the curing room 14, as it will be described in more details below, along the displacement axis 26.

In the embodiment shown, an inner volume of the curing room 14 which is at least partially delimited by the floor 16, the walls 18*a*, 18*b*, 18*c* and 18*d* and the ceiling 20 thereof (at least partially delimited by inner surfaces thereof), is between about 5 $m^3$ and about 1000 $m^3$, between about 20 $m^3$ and about 500 $m^3$, or between about 200 $m^3$ and about 350 $m^3$.

Still referring to the implementation of FIGS. 1 to 6, the system 10 can further include a conveyor 30 (or curing room conveyor 30), downstream from the painting room conveyor 9, for receiving the coated wood substrate 12 thereon, and conveying the coated wood substrate 12 through the curing room 14, from the curing room inlet 22 towards the curing room outlet 24. For example, the curing room conveyor 30 can be a gravity roller conveyor, a power belt conveyor, a skate wheel conveyor, a powered roller conveyor, or any other conveyor which can convey the coated wood substrate 12 through the curing room 14 from the curing room inlet 22 towards the curing room outlet 24.

In one implementation, the coated wood substrate 12 can be conveyed through the curing room 14 at a speed of between about 0.50 m/s and about 3 m/s, of between about 1 m/s and about 2.5 m/s, or of between about 1.5 m/s and about 2 m/s. Additionally, the distance between the curing room inlet 22 and the curing room outlet 24 can be between about 3 meters and about 20 meters, between about 5 meters and about 18 meters, or between about 7 meters and about 16 meters. It is noted that any other mechanisms can be used to displace the coated wood substrate 12 through the curing room 14 along the direction axis 26, or other direction not necessarily longitudinal.

In one scenario, the coated wood substrate 12 can be conveyed through the curing room 14 in a horizontal orientation, with a bottom surface thereof facing the floor 16 of the curing room 14 and a top surface thereof facing the ceiling 20 of the curing room or vice versa, for example. In another scenario, the coated wood substrate 12 can be conveyed through the curing room 14 in a vertical configuration, with its bottom surface facing the curing room inlet 22 and its top surface facing the curing room inlet 24 or vice versa, for example, or with its bottom surface facing the wall 18*b* (i.e. a first side wall) and its top surface facing the wall 18*d* (i.e., a second side wall) or vice versa, for example. It can also be understood that a plurality of spaced apart coated wood substrates 12 can be conveyed, one after the other, through the curing room 14 via the curing room conveyor 30. Alternatively, a plurality of coated wood substrates 12 can be stacked, one on top of the other, and conveyed, providing a sufficient distance between adjacent coated wood substrates 12, so that the IR radiation emitted in the different curing room sections of the curing room 14 can reach the wet coating 35 to be cured.

Still referring to the implementation of FIGS. 1 to 6, the curing room 14 can include (or be dividable into along the displacement axis, i.e., dividable into along a longitudinal axis of the curing room 14) at least an upstream curing section 32, as well as a downstream curing section 36.

The upstream curing section 32 can include gas catalytic IR heaters 38*a*, 38*b*, 38*c*, 38*d* or upstream gas catalytic IR heaters (FIG. 5) for producing an upstream IR radiation, at an upstream radiation intensity. The upstream IR radiation can thus be emitted from the upstream gas catalytic IR heaters 38*a*, 38*b*, 38*c*, 38*d* towards the exposed wet coating 13 of the coated wood substrate 12, so it can be cured, at least in part.

Similarly, the downstream curing section 36, which is positioned downstream from the upstream curing section 32, either directly or indirectly, can include gas catalytic IR heaters 42*a*, 42*b*, 42*c*, 42*d* or downstream gas catalytic IR heaters (FIG. 5) for producing a downstream IR radiation, at a downstream radiation intensity, which can be lower than the upstream radiation intensity. The downstream IR radiation can thus be emitted from the downstream gas catalytic IR heaters 42*a*, 42*b*, 42*c*, 42*d* towards the remaining wet coating 13, so it can be fully cured.

Still referring to the implementation of FIGS. 1 to 6, optionally, the system 10 can include an intermediate curing section 34, positioned between the upstream curing section 32 and the downstream curing section 36 (i.e., downstream, either directly or indirectly, the upstream curing section 32 and upstream, either directly or indirectly, the downstream curing section 36). Similarly, the intermediate curing section 34 can include intermediate gas catalytic IR heaters 40*a*, 40*b*, 40*c*, 40*d* or intermediate gas catalytic heaters for producing an intermediate IR radiation, at an intermediate radiation intensity, which can be lower than the upstream radiation intensity, but higher than the downstream radiation intensity. The intermediate IR radiation can thus be emitted from the intermediate gas catalytic heaters 40*a*, 40*b*, 40*c*, 40*d* towards the remaining wet coating 13, so it can be cured (e.g., bottom up), at least in part, prior the coated wood substrate 12 can reach the downstream curing section 36. It is noted that each one of the upstream, intermediate and downstream curing sections 32, 34, 36 of the curing room 14 can include one or more gas catalytic IR heater(s), as long as each curing section produces sufficient IR radiation to heat the film of wet coating 13, at least in part. It is also noted that no flash-off of the water present in the wet coating 13 is needed prior to cure the film of coating using the system 10, as an important amount of water will be released from the wet coating in the upstream curing section 32 of the system 10, as it will be described in more details below. Thus, for example, the wet coating 13 can absorb the infrared heat emitted in the upstream curing section 32 just after the wood substrate 15 has been coated.

As mentioned above, the gas catalytic IR heaters produce medium to long IR waves, which allow the infrared radiation to be absorbed by the wet coating 13 of the coated wood substrate 12, rather than by the wood substrate 15 itself. The upstream IR radiation produced by the upstream gas catalytic IR heaters 38*a*, 38*b*, 38*c*, 38*d* can thus be absorbed, at least in part, by the wet coating 13 applied to the wood substrate 15 being conveyed through the upstream curing section 32. The wet coating 13 can thus be cured in part, from a lower layer of the coating 13 towards an upper layer of the coating 13. The water present in the wet coating 13 can therefore be expelled therefrom in the upstream curing section 32 of the curing room 14, increasing a temperature of the air stream produced in the upstream curing section 32, and a water content the air stream present in the upstream curing section 32. Once the partially cured coated wood substrate 12 has reached the intermediate curing section 34 of the curing room 14, the intermediate IR radiation produced by the intermediate gas catalytic IR heaters 40*a*, 40*b*, 40*c*, 40*d* can be absorbed, at least in part, by the remaining wet coating 13, so it can be cured in part, inside out. The water remaining in the wet coating 13, if any, can also be expelled therefrom in the intermediate curing section 34 of the curing room 14. Once the partially cured coated wood substrate 12 has reached the downstream curing section 36 of the curing room 14, the downstream IR radiation produced by the downstream gas catalytic IR heaters 42*a*, 42*b*, 42*c*, 42*d* can thus be absorbed, at least in part, by the remaining wet coating 13, so it can be fully cured, bottom up. The water remaining in the wet coating 13, if any, can also be expelled therefrom in the downstream curing section 36 of the curing room 14. The system 10 is thus zoned or divided to provide more energy output for the initial heat up stage and lower energy output for the levelling or "hold" stage.

As mentioned above, the wavelength of the upstream IR radiation produced by the upstream gas catalytic IR heaters 38*a*, 38*b*, 38*c*, 38*d* needs to be such that the film of wet coating 13 can be cured bottom up. Thus, in one implementation, the upstream IR radiation can have a wavelength of between about 5 μm and about 10 μm, of between about 6 μm and about 9 μm, or of between about 7 μm and about 8 μm. Additionally, the upstream radiation intensity can be between about 40,000 btu and about 70,000 btu, between about 45,000 btu and about 65,000 btu, or between about 50,000 btu and about 60,000 btu (e.g., when using natural gas as the combustible gas of the upstream gas catalytic IR heaters). It is noted that the upstream radiation intensity can be lower when using propane as the combustible gas. For example, the upstream radiation intensity can be set to between about 70% and about 100% of the total radiation intensity permitted by the gas catalytic IR heaters. The wet coating 13 applied to the coated wood substrate 12 can thus be heated, in the upstream curing section 32, from an initial temperature, the ambient temperature for example, to an upstream temperature and therefore, be partially cured. For example, the upstream temperature of the wet coating 13 can be between about 40° C. and about 80° C., between about 50° C. and about 70° C., or between about 55° C. and about 65° C., once the coated wood substrate 12 has passed through the upstream curing section 32.

On the other hand, the intermediate IR radiation emitted in the intermediate curing section 34 can have a wavelength of between about 1 μm and about 7 μm, of between about 2 μm and about 6 μm, or of between about 2 μm and about 5 μm. Additionally, the intermediate radiation intensity can be between about 28,000 btu and about 49,000 btu, between about 31,500 btu and about 45,500 btu, or between about 35,000 btu and about 42,000 btu (e.g., when using natural gas as the combustible gas of the intermediate gas catalytic IR heaters). It is noted that the intermediate radiation intensity can be lower when using propane as the combustible gas. For example, the intermediate radiation intensity can be set to between about 50% and about 70% of the total radiation intensity permitted by the gas catalytic IR heaters. The remaining wet coating 13 can thus be heated from the upstream temperature to an intermediate temperature, prior to obtaining the cured coated wood substrate 28. For example, the intermediate temperature can be between about 50° C. and about 80° C., between about 55° C. and about 75° C., or between about 60° C. and about 70° C., once the coated wood substrate 12 has passed through the intermediate curing section 34.

It is also noted that the downstream IR radiation emitted in the downstream curing section 36 can have a wavelength of between about 1 μm and about 7 μm, of between about 2 μm and about 6 μm, or of between about 2 μm and about 5 μm. Additionally, the downstream radiation intensity can be between about 24,000 btu and about 42,000 btu, between about 27,000 btu and about 39,000 btu, or between about 30,000 btu and about 36,000 btu (e.g., when using natural gas as the combustible gas of the downstream gas catalytic IR heaters). It is noted that the downstream radiation intensity can be lower when using propane as the combustible gas. For example, the downstream radiation intensity can be set to between about 40% and about 70% of the total radiation intensity permitted by the gas catalytic IR heaters. The remaining wet coating 13 can thus be heated from the intermediate temperature to a downstream temperature (i.e., a cured temperature) so that the coating can be fully cured. For example, the downstream temperature can be between about 55° C. and about 85° C., between about 60° C. and about 80° C., or between about 65° C. and about 75° C., once the coated wood substrate 12 has passed through the downstream curing section 36.

The cured coating 48 (FIGS. 9 to 11) can be cooled from the downstream temperature to the initial temperature of the wet coating 13, ambient temperature for example, in less than about 30 seconds, less than about 25 seconds, less than about 20 seconds, less than about 15 seconds, less than about 10 seconds, or less than 5 seconds. As detailed below, the system might comprise a ventilation system 71 contributing at least partially to the cooling of the cured coating and thus easing the handling of the cured coated substrates.

The fully cured coated wood substrate 28 can thus be handled, stacked, stored, shipped, etc., substantially immediately after the curing process has occurred, without being damaged, as full polymerisation of the coating along full thickness thereof has been performed.

It is appreciated that the shape and the configuration of the curing room, as well as the shape, the configuration, the number and the location of the curing sections thereof can vary from the embodiment shown. It could for instance be conceived a curing room which would only comprise two curing sections (i.e., wherein the upstream and downstream curing sections would be directly adjacent to each other) or more than three curing sections (i.e., comprising a plurality of intermediate curing sections between upstream and downstream curing sections thereof).

Pre-Curing—or Flash-Up—Room

In one implementation, as best shown in FIGS. 1 to 6, the system 10 can further include a pre-curing room 500 for receiving the coated wood substrate 12 once it has been coated by the spraying or brushing equipment 11 (FIG. 1). In other words, in the embodiment show, the pre-curing room 500 is downstream the wet coating spraying or brushing equipment 11 and upstream the curing room 14, for instance upstream the upstream curing section 32 thereof.

The pre-curing room 500 can include a floor 516, which has a floor periphery, and walls 518*a*, 518*b*, 518*c*, 518*d*, which substantially upwardly extend from the floor 516 at the floor periphery thereof. The pre-curing room or flash-up room 500 can further include a ceiling 520, a pre-curing room inlet 522, which can be formed in the wall 518*a* for example, as well as a pre-curing room outlet 524, which can be formed in the wall 518*c* for example. In the implementation of FIGS. 1 to 6, the pre-curing room outlet 524 is located opposite to the pre-curing room inlet 522, so that the coated wood substrate 12 can be displaced through the pre-curing room 500, using the curing room conveyor 30 which can extend through the pre-curing room 500 for example, from the pre-curing room inlet 522 towards the pre-curing room outlet 524, along the displacement axis 506 (for instance a centerline of the pre-curing room 500) to allow continuous curing operations. The pre-curing room 500 can take any shape, size or configuration, as long as it allows the coated wood substrate 12 to be displaced therethrough along the displacement axis 506, from the wet coating spraying or brushing equipment 11 towards the curing room 14. It is noted that the pre-curing room 500 can be configured in a sealed engagement with a paint spraying or brushing room 7 which receives the wet coating spraying or brushing equipment 11. Thus, the coated wood substrate can travel from the equipment 11 towards the curing room 14 without being in contact with ambient air.

Figure 2:
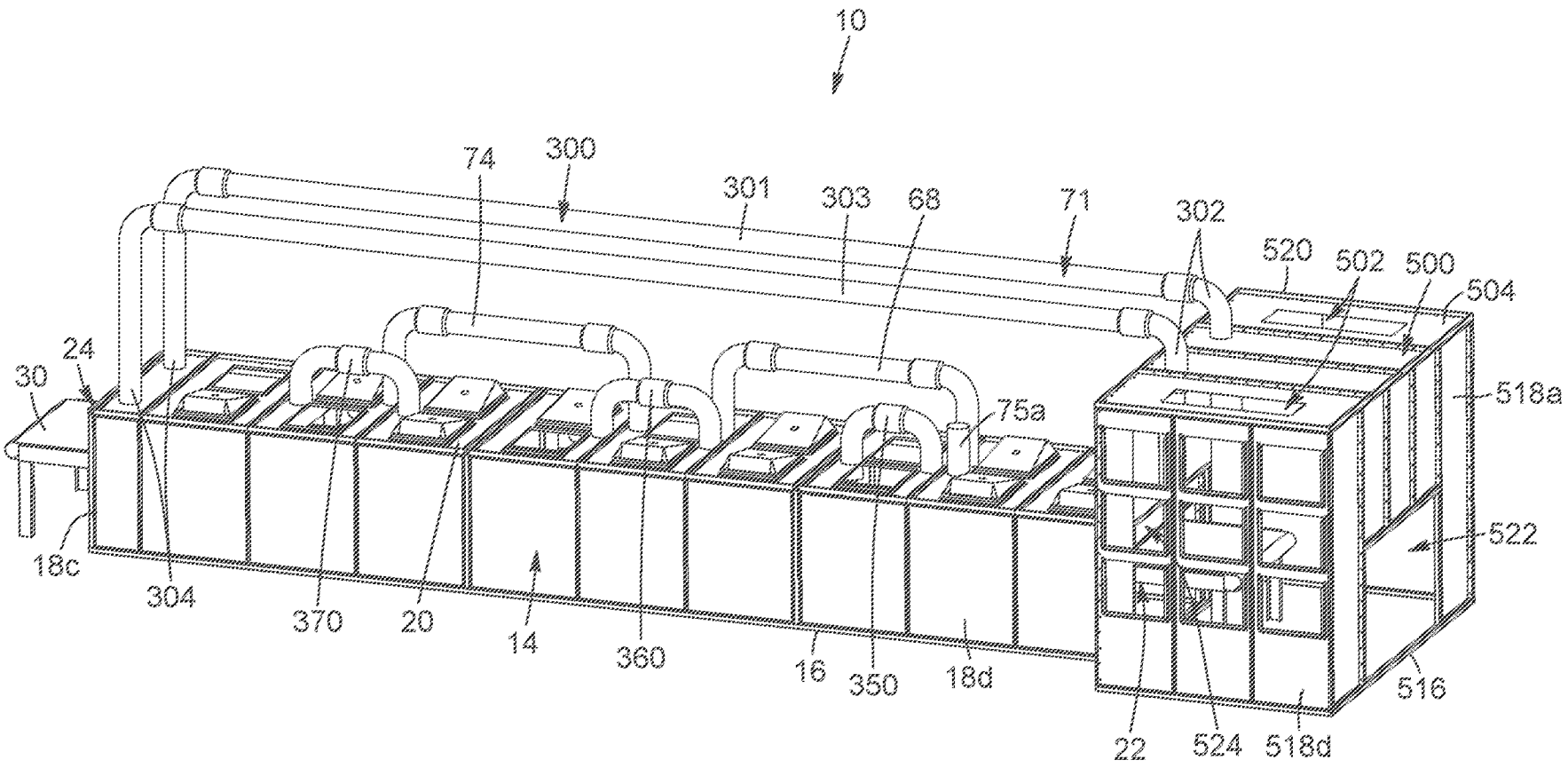
FIG. 2 is a second top perspective view of the system of FIG. 1.
Figure 3:
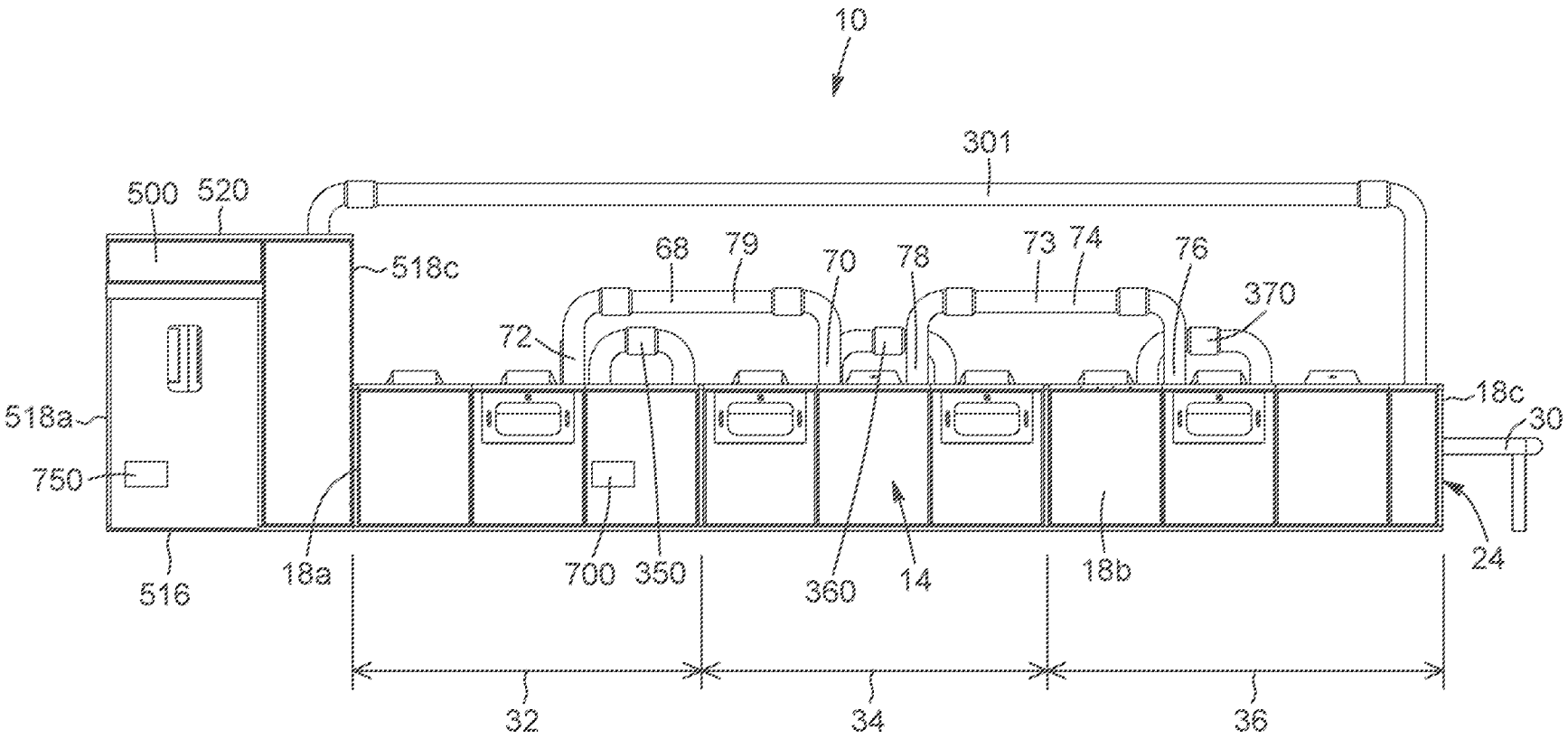
FIG. 3 is a first side elevational view of the system of FIG. 1.
Figure 4:
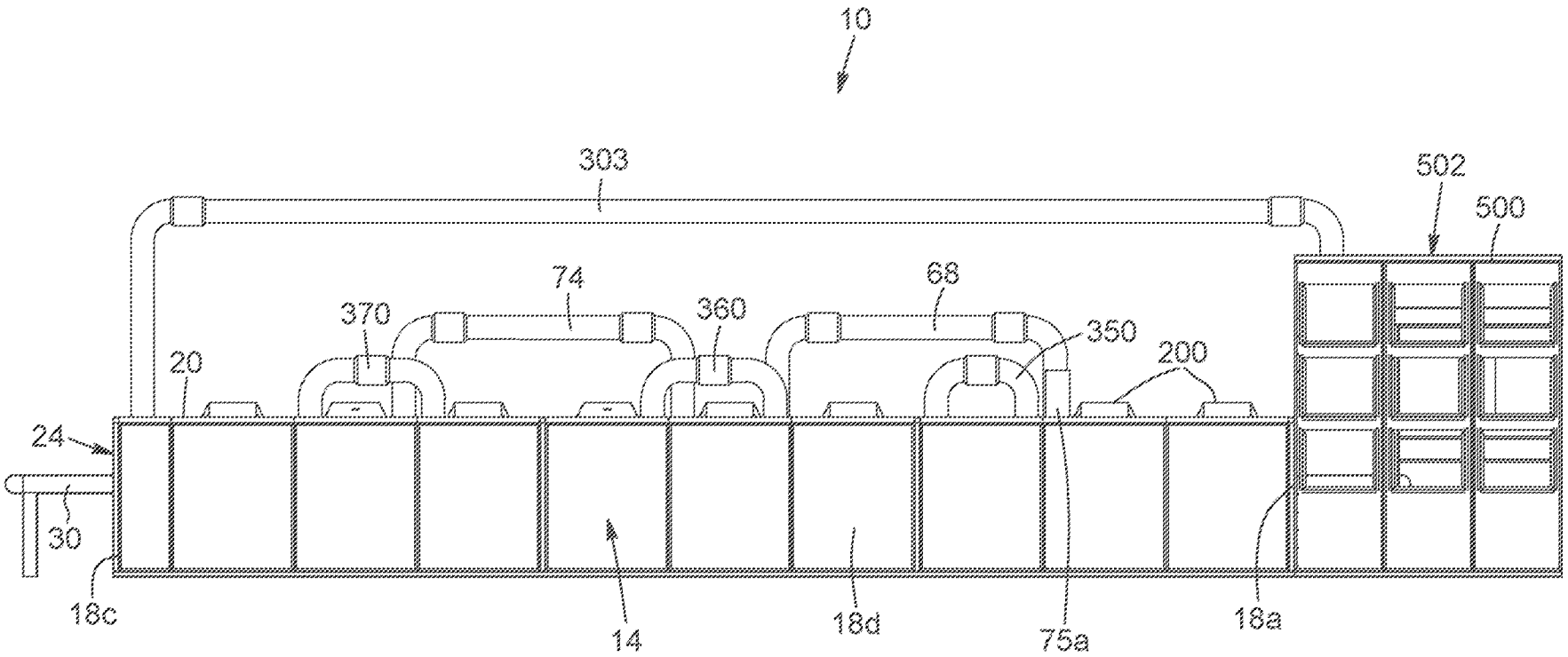
FIG. 4 is a second side elevational view of the system of FIG. 1.

As shown, the pre-curing room 500 can include an air stream inlet 502 for allowing ambient air to flow therethrough towards the pre-curing room outlet 524, and then, to flow through the curing room 14, from the upstream curing section 32 towards the downstream curing section 36. The pre-curing room 500 can further include air filtering elements 504 at the air stream inlet 502 so that ambient air can be filtered prior to being received within the curing room 14 of the system 10 via the pre-curing room 500. As best shown in FIGS. 1 and 2, the pre-curing room outlet 524 of the pre-curing room 500 can be at least partially superposed to the curing room inlet 22 of the curing room 14 in an airtight manner. In other words, the pre-curing room outlet 524 is fluidly connected to the curing room inlet 22 in an airtight manner in the embodiment shown.

Gas Catalytic IR Heaters

In the embodiment shown, gas catalytic IR heaters arranged in the curing room 14 (for instance in the upstream, intermediate and downstream curing sections thereof) have a similar shape, so that the following description of one of the gas catalytic IR heaters will apply to any of them.

Figure 7:
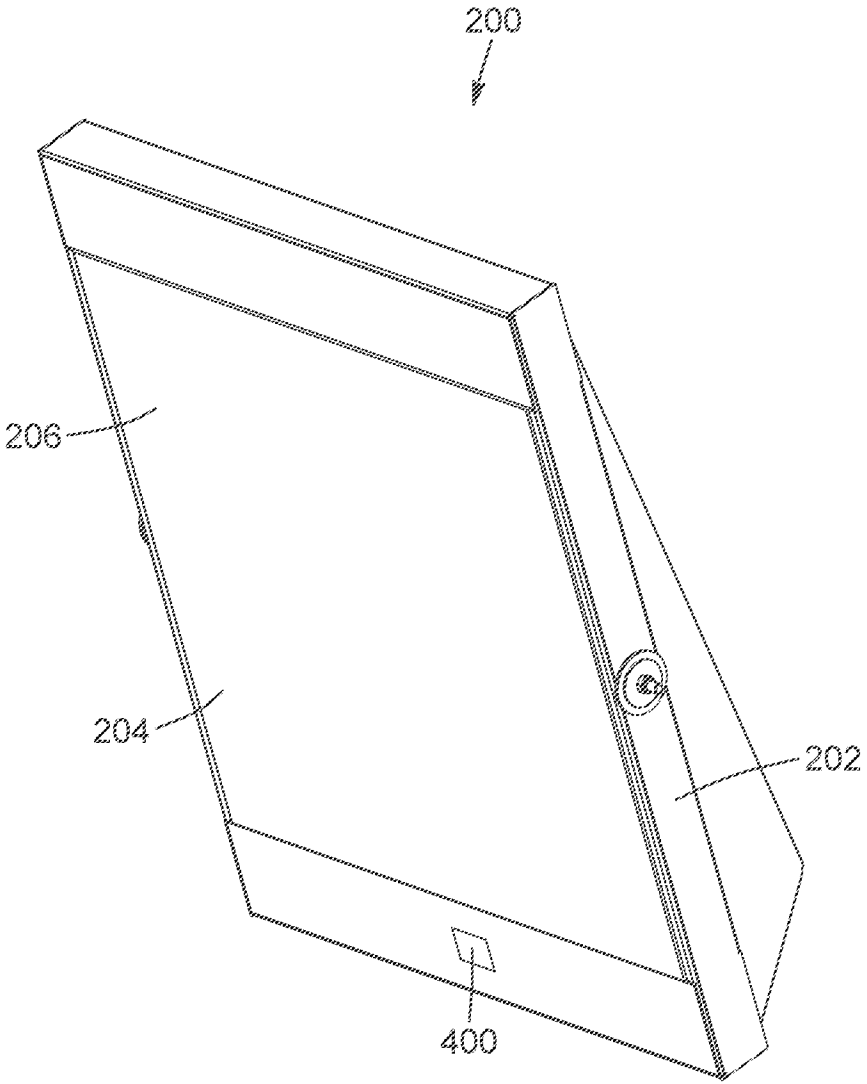
FIG. 7 is a perspective view of one of the gas catalytic infrared heaters of the system of FIG. 1.

As best shown in FIG. 7, a gas catalytic IR heater (upstream, intermediate and downstream gas catalytic IR heaters) is shown, which can be generally referred to as 200. The gas catalytic IR heater 200 includes a main body—or heater body—202 and a catalytic pad 204 defining an emitting surface. The catalytic pad 204 can be made from a fibrous, ceramic material such as silica or alumina, for example, and is infused with an oxidation catalyst, which can include a noble metal such as platinum, palladium or the oxides of chromium, cobalt or copper, or mixtures thereof for example. A wire mesh 206 rests on top of the catalytic pad 204 and allows for easy access of air and oxygen to the surface of the catalytic pad 204 from the surrounding atmosphere. A chamber (not shown), in fluid communication with the catalytic pad 204, contains the combustible gas to be supplied to the catalytic pad 204. In the presence of the oxidation catalyst, catalytic combustion occurs when the combustible gas (e.g., a gaseous hydrocarbon such as natural gas, propane, butane, etc.), in the presence of the oxidizer gas (e.g., oxygen), produces carbon dioxide, water, and heat. The ignition temperature of the combustible gas occurs at substantially low temperatures. Therefore, no flame is involved in the combustion process and the infrared waves are created, producing radiant heat the upstream, intermediate and downstream IR radiation.

Referring back to the implementation of FIGS. 1 to 6, the upstream curing section 32 of the curing room 14 can include a plurality (for instance four) gas catalytic IR heaters 38*a*, 38*b*, 38*c*, 38*d*, the intermediate curing section 34 can include a plurality (for instance four) gas catalytic IR heaters 40*a*, 40*b*, 40*c*, 40*d*, while the downstream curing section 36 can include a plurality (for instance four) gas catalytic IR heaters 42*a*, 42*b*, 42*c*, 42*d*. It is noted that each curing section 32, 34, 36 can include more or less gas catalytic IR heaters.

The distance between each one of the catalytic heaters 38*a*, 38*b*, 38*c*, 38*d*, 40*a*, 40*b*, 40*c*, 40*d*, 42*a*, 42*b*, 42*c*, 42*d* and the curing room conveyor 30 can be between about 1 meter and about 5 meters, between about 2 meters and about 4 meters, or between about 2.5 meters and about 3.5 meters. It is noted that if the gas catalytic IR heaters are positioned too close to the curing room conveyor 30 (i.e., too close to the coated wood substrate), overheating of the coating can occur, resulting in blistering of the film.

Figure 12:
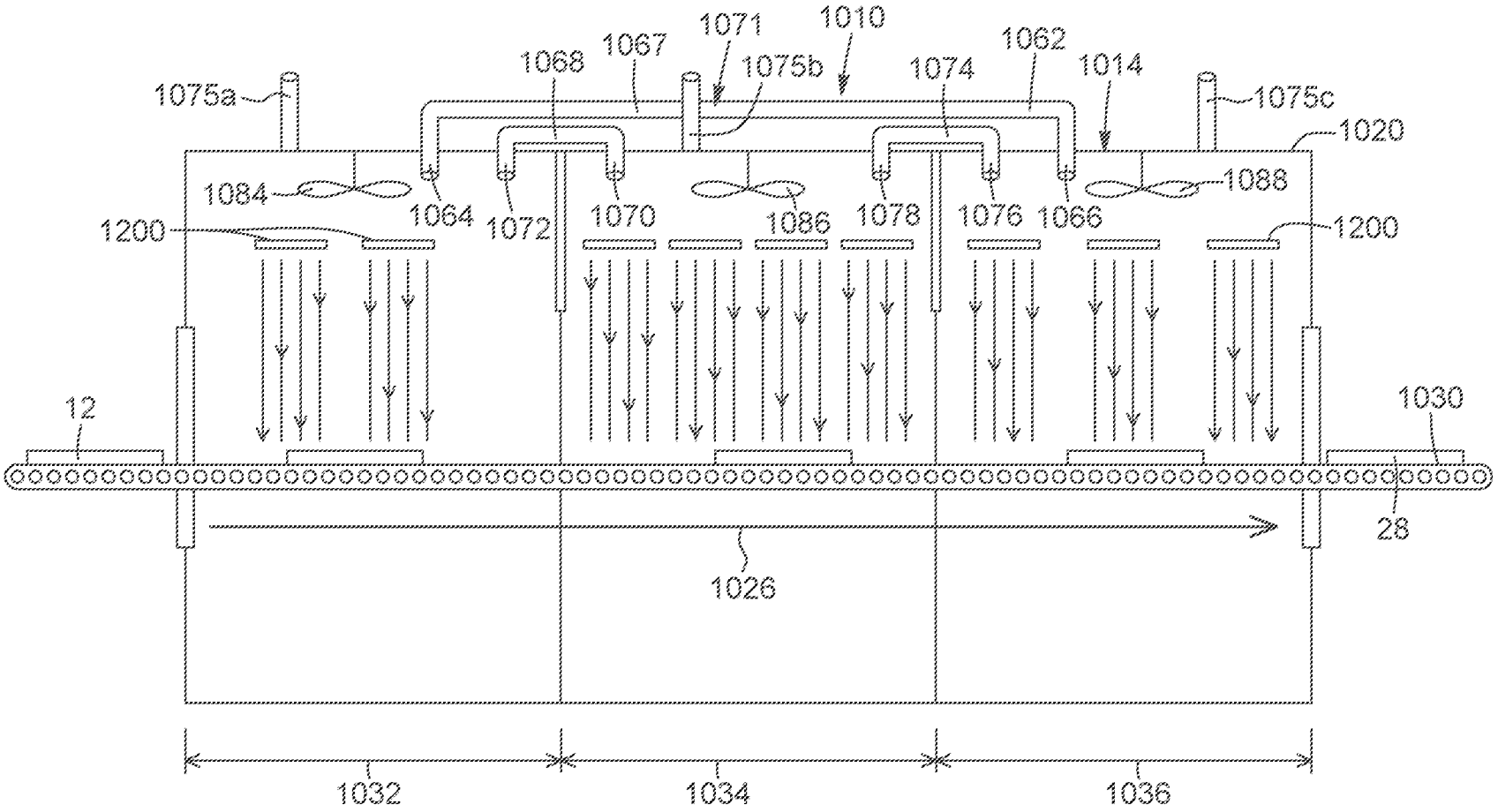
FIG. 12 is a schematic cross-section view of a system for curing a wet coating applied to a substrate in accordance with a second embodiment.

Because the infrared energy is radiant, the energy can only travel in a straight line, as represented for instance in FIG. 12. The coated wood substrate 12 therefore needs to be substantially facing the emitting surface of the gas catalytic infrared heaters 38*a*, 38*b*, 38*c*, 38*d*, 40*a*, 40*b*, 40*c*, 40*d*, 42*a*, 42*b*, 42*c*, 42*d*. Thus, as best shown in the implementation of FIG. 6, the gas catalytic infrared heaters 38*a*, 38*b*, 38*c*, 38*d*, 40*a*, 40*b*, 40*c*, 40*d*, 42*a*, 42*b*, 42*c*, 42*d* of the upstream, intermediate and downstream curing sections 32, 34, 36 of the curing room 14 can be mounted about the ceiling 20 of the curing room 14 with their emitting surfaces facing substantially the conveyor 30. Thus, in operation, the coated wood substrate 12 can be conveyed in its horizontal configuration with the wet coating applied to its upper surface. The upstream, intermediate and downstream IR radiation emitted respectively by the upstream, intermediate and downstream gas catalytic infrared heaters 38*a*, 38*b*, 38*c*, 38*d*, 40*a*, 40*b*, 40*c*, 40*d*, 42*a*, 42*b*, 42*c*, 42*d* can therefore be substantially perpendicular to the surface of the wet coating 12. It is however noted that the gas catalytic IR heaters 38*a*, 38*b*, 38*c*, 38*d*, 40*a*, 40*b*, 40*c*, 40*d*, 42*a*, 42*b*, 42*c*, 42*d* can take any configuration in the curing room 14, as long as the emitting surfaces can substantially face the wet coating to be cured so that the upstream, intermediate and downstream IR radiation emitted can be substantially perpendicular to the wet coating to be cured. In other words, each one of the gas catalytic IR heaters 38*a*, 38*b*, 38*c*, 38*d*, 40*a*, 40*b*, 40*c*, 40*d*, 42*a*, 42*b*, 42*c*, 42*d* of the upstream, intermediate or downstream curing sections 32, 34, 36 can be mounted to an inner surface of a wall 18*a*, 18*b*, 18*c*, 18*d*, or alternatively, to an inner surface or conveyor-facing surface of the ceiling 20, as long as the infrared radiation, at least in part, can be emitted in the direction of the coated wood substrate 12 being conveyed through the curing sections 32, 34, 36 of the curing room.

It is also noted that the upstream emitting surface (emitting surfaces of the upstream gas catalytic IR heaters 38*a*, 38*b*, 38*c*, 38*d*) can represent between about 30% and about 100%, between about 40% and about 90%, or between about 50% and about 80% of the footprint of the upstream curing section 32, the downstream emitting surface (emitting surfaces of the downstream gas catalytic IR heaters 42*a*, 42*b*, 42*c*, 42*d*) can represent between about 30% and about 100%, between about 40% and about 90%, or between about 50% and about 80% of the footprint of the downstream curing section 36, and the intermediate emitting surface (emitting surfaces of the intermediate gas catalytic IR heaters 40*a*, 40*b*, 40*c*, 40*d*) can represent between about 30% and about 100%, between about 40% and about 90%, or between about 50% and about 80% of the footprint of the intermediate curing section.

In each one of the curing sections 32, 34, 36 composing at least partially the curing room 14, more or less distance can thus be provided between adjacent ones of the corresponding gas catalytic IR heaters 38*a*, 38*b*, 38*c*, 38*d*, 40*a*, 40*b*, 40*c*, 40*d*, 42*a*, 42*b*, 42*c*, 42*d*. Indeed, as shown in FIG. 5, since the upstream IR radiation needs to be higher than the intermediate IR radiation and/or the downstream IR radiation, less distance can be provided between the upstream gas catalytic IR heaters than between the intermediate gas catalytic heaters and/or between the downstream gas catalytic heaters. For example, the intermediate gas catalytic heaters 40*a*, 40*b*, 40*c*, 40*d* can be provided in a staggered configuration in the intermediate curing section 34 and/or in the downstream curing section 36.

It is appreciated that the shape, the configuration, the location and/or the number of the gas catalytic IR heaters arranged in the upstream, intermediate and downstream curing sections of the curing room can vary from the embodiment shown. It could also be conceived a curing room with different gas catalytic IR heaters being arranged in the upstream, downstream and/or intermediate curing sections of the curing room.

Ventilation System

Referring back to the implementation of FIGS. 1 to 6, the system 10 can further include the above-mentioned ventilation system 71 for uniformizing the heated air stream(s) in at least one of the upstream, intermediate and/or downstream curing sections and/or recirculating the heated air stream from at least one of the upstream, intermediate and/or downstream curing sections towards at least another one of the upstream, intermediate and/or downstream curing sections.

For instance, the term "uniformize" should be understood as designating a difference of less than about 10%, for instance less than about 5%, for instance less than about 2%, for instance less than about 1% between extreme values of temperatures and/or humidity rates in the corresponding section of the curing room. Moreover, as detailed below, the ventilation system 71 is also shaped and dimensioned for least one of lowering an inner pressure of the pre-curing room 500 and cooling the cured coated substrate at the curing room outlet 24. In other words, the ventilation system 71 is configured for circulating the heated and/or humid air contained in at least one of the upstream, intermediate or downstream curing sections 32, 34, 36 towards at least another one of the curing sections 32, 34, 36 (i.e., comprises at least one intersection recirculation duct) or within at least one of the upstream, intermediate or downstream curing sections 32, 34, 36 (i.e., comprises at least one intrasection recirculation duct). In other words, the ventilation system 71 is shaped and dimensioned to at least partially recycle within the curing room 14 the heated air stream produced in at least one of the different sections thereof.

As shown in FIGS. 1 and 2, the ventilation system 71 can comprise at least one cooling and pressure-lowering duct 300 comprising a cooling duct inlet 302 at the pre-curing room 500 (i.e., fluidly connected with an inner volume of the pre-curing room 500) and a cooling duct outlet 304 at the curing room outlet 24 or in the vicinity thereof. The cooling and pressure-lowering duct 300 is thus shaped and dimensioned for the pre-curing room 500 to be provided with a pressure gradient of about 0 or being slightly below 0 (i.e., with a negative pressure). The cooling and pressure-lowering duct 300 is also shaped and dimensioned to direct an air flow (for instance cool ambient air) received in the pre-curing room 500 via the above-mentioned air stream inlet 502 at least partially towards the curing room outlet 24 in order to lower a temperature of the cured coated substrates.

In the embodiment shown, the ventilation system 71 comprises two substantially parallel air circulation ducts 301, 303 extending between the pre-curing room 500 and the curing room outlet 24. One of the air circulation ducts 301 could be designed for cooling the cured coated substrates, while the other one of the air circulation ducts 303 could be designed for lowering the inner pressure of the pre-curing room 500. It could also be conceived a single air circulation duct that would be configured to both cool the cured coated substrates and lower the inner pressure of the pre-curing room or more than two ducts extending between the pre-curing room and the curing room outlet.

In the embodiment shown, the ventilation system 71 further comprises at least one exhaust 75*a* having an inlet at the upstream curing section 32 and an outlet for expelling air out of the curing room 14, when needed. Other exhausts could be arranged in fluid communication with an inner volume of the curing room (for instance at the intermediate and/or downstream curing sections thereof).

As best shown in FIGS. 1 and 2, the ventilation system 71 can optionally include an intersection recirculation duct having an inlet at the downstream curing section 36 and an outlet at the upstream curing section 32 of the curing room 14 for recirculating the heated air stream produced in the downstream curing section towards the upstream curing section. The intersection recirculation duct can either directly fluidly connect the downstream and upstream curing sections, or, as in the embodiment shown, comprise a first intersection recirculation duct 74 having an inlet 76 at the downstream curing section 36 and an outlet 78 at the intermediate curing section 34 for recirculating the heated air stream produced in the downstream curing section towards the intermediate curing section; and a second intersection recirculation duct 68 having an inlet 70 at the intermediate curing section 34 (proximate, for instance upstream, the outlet 78 of the first recirculation duct 74) and an outlet 72 at the upstream curing section 32 for recirculating the heated air stream produced in the intermediate curing section towards the upstream curing section. In other words, the intersection recirculation duct is divided in the embodiment shown into two distinct recirculation sub-ducts for recirculating the heated air stream produced in the downstream curing section towards the upstream curing section via the intermediate curing section.

In other words, the ventilation system 71 comprises at least a first recirculation duct 74 having its inlet 76 at the third—or downstream—curing section 36 and its outlet 78 at the second—intermediate—curing section 34 for directing a second heated/humid air stream 73 from the third—or downstream—heated section 36 towards the second—or intermediate—curing section 34 so as to expel (or at least partially reuse or recycle) the heated/humid air, at least in part, from the downstream curing section 36. The ventilation system 71 includes in the embodiment shown a second recirculation duct 68 having its inlet 70 at the intermediate curing section 34 and its outlet 72 at the upstream curing section 32 for directing a third heated air stream 79 from the intermediate curing section 34 towards the upstream curing section 32 to expel (or at least partially reuse or recycle) the heated/humid air from the intermediate curing section 34.

Recirculating the air from the downstream curing section 36 towards the intermediate curing section 34, and from the intermediate curing section 34 towards the upstream curing section 32 (or possibly or in addition directly from the downstream curing section 36 towards the upstream curing section 32), can help in uniformizing the water content of the air streams present in the different curing sections 32, 34, 36. Uniformizing the water content present in the air streams of the curing sections 32, 34, 36 can therefore reduce the air flow rates at the exhaust 75*a*, so that the curing room 14 can be provided with a pressure gradient of about 0. Indeed, recirculating (i.e., at least partially recycling) the heated humid air between the curing sections 32, 34, 36 can help in obtaining a curing room 14 having a pressure gradient being slightly below 0 (negative pressure). Since the pressure in the curing room 14 and/or in the pre-curing room 500 is slightly negative, dust and dirt contamination can be prevented or at least limited from reaching the wet coating 13. The above-mentioned air filtering elements 504 at the air stream inlet 502 formed in the pre-curing room 500 further contribute to limiting the risk that dust and dirt could contaminate the wet coating 13. Rather, conventional curing rooms with no ventilation system need to expel air, which contains, as mentioned above, a high content of water, from the curing room (from the exhaust(s)), at an important flow rate to fully cure the wet coating in a small amount of time. Expelling air from the curing room at an important flow rate can lead to contamination of the wet coating, as ambient air will naturally be forced to flow through the curing room, with its contaminants. Thus, providing the system 10 with a ventilation system 71, as well as with filtering elements 504, for instance at the air stream inlet 502 of the pre-curing room 500, can help in reducing the curing time of the wet coating, and can prevent contamination of the wet coating being cured.

In the embodiment shown, the ventilation system 71 further comprises at least one at least one intrasection recirculation duct having an inlet and an outlet both at one of the upstream, intermediate and downstream curing sections for uniformizing the heated air stream produced within the corresponding one of the upstream, intermediate and downstream curing sections. In the embodiment shown, the ventilation system 71 comprises upstream, intermediate and downstream intrasection recirculation ducts 350, 360, 370 each of them having an inlet 352, 362, 372 and an outlet 354, 364, 374 both respectively at the upstream, intermediate and downstream curing sections 32, 34, 36.

It is appreciated that the shape, the configuration, and the location of the ventilation system, as well as the shape, the configuration, the number and/or the relative arrangement of the intrasection recirculation ducts, the intersection recirculation ducts and/or the cooling and pressure-lowering duct thereof can vary from the embodiment shown.

For instance, FIG. 12 represents another possible embodiment of a system 1010 for curing a wet coating of a coated substrate. Similarly to the first embodiment, the system 1010 comprises a curing room 1014 configured to receive the coated substrate being displaced along a displacement axis 1026 for instance via a curing room conveyor 1030. The curing room comprises (or is dividable along the displacement axis into) at least an upstream curing section 1032, an intermediate curing section 1034 and a downstream curing section 1036. The upstream, intermediate and downstream curing sections comprise each one or more gas catalytic IR heater 1200, an upstream infrared radiation being produced at an upstream radiation intensity in the upstream curing section which is greater than an intermediate radiation intensity of an intermediate infrared radiation produced in the intermediate curing section. Moreover, the intermediate radiation intensity is greater than a downstream radiation intensity of a downstream infrared radiation produced in the downstream curing section.

The system 1010 further comprises a ventilation system 1071 having at least an inlet at one of the upstream, intermediate and downstream curing sections; and at least an outlet at one of the upstream, intermediate and downstream curing sections. The ventilation system 1071 is shaped and dimensioned to uniformize in the corresponding one of the upstream, intermediate and downstream curing sections a heated air stream produced therein and/or recirculate from one of the upstream, intermediate and downstream curing sections towards another one of the upstream, intermediate and downstream curing sections the heated air stream produced in said one of the upstream, intermediate and downstream curing sections.

In the embodiment shown, the ventilation system 1071 can include a first recirculation duct 1062—forming at least partially an intersection recirculation duct—which has an inlet 1064 at the upstream curing section 1032 and an outlet 1066 at the downstream curing section 1036 for directing a first heated/humid air stream 1067 from the upstream curing section 1032 towards the downstream curing section 1036 so as to expel the heated/humid air containing water expelled from the wet coating, at least in part, from the upstream curing section 1032.

In the embodiment shown, the intersection recirculation duct further comprises a second intersection recirculation duct 1074 having an inlet 1076 at the downstream curing section 1036 and an outlet 1078 at the intermediate curing section 1034 for recirculating the heated air stream produced in the downstream curing section towards the intermediate curing section; and a third intersection recirculation duct 1068 having an inlet 1070 at the intermediate curing section 1034 and an outlet 1072 at the upstream curing section 1032 for recirculating the heated air stream produced in the intermediate curing section towards the upstream curing section.

The ventilation system 1071 further includes an upstream exhaust 1075*a* having an inlet at the upstream curing section 1034 and an outlet for expelling air out of the curing room 1014, when needed. The ventilation system 1071 further includes an intermediate exhaust 1075*b* having an inlet at the intermediate curing section 1034 and an outlet for expelling air out of the curing room 1014, when needed. The ventilation system 1071 can further include an exhaust 1075*c* having an inlet at the downstream curing section 1032 and an outlet for expelling air out of the curing room 1014, when needed.

In the embodiment shown, the ventilation system 1071 can also include one or more fans 1084, 1086, 1088, which can be provided in an upper section of the curing room 1014. More particularly, the upstream fan 1084 can be provided in an upper section of the upstream curing section 1032, the intermediate fan 1086 can be provided in an upper section of the intermediate curing section 1034, while the downstream fan 1088 can be provided in an upper section of the downstream curing section 1036, so as to enhance air recirculation between and within the curing sections 1032, 1034, 1036. For example, the fans 1084, 1086, 1088 can downwardly extend from the ceiling 1020 of the curing room 1014 in respectively the curing sections 1032, 1034, 1036 of the curing room 1014.

It is appreciated that the shape and the configuration of the ventilation systems 71, 1071 can vary from the embodiments shown and features thereof could be combined together.

Room Section Separator

In the embodiment shown, referring back to FIGS. 1 to 6, the upstream curing section 32, the intermediate curing section 34 and the downstream curing section 36 of the curing room 14 can be partially separated. As best shown in FIG. 6, the system 10 comprises a room section separator to partially separate adjacent curing sections, either directly or indirectly adjacent. In the embodiment shown, the room section separator comprises first and second section separators 80, 82 shaped and dimensioned to partially separate the curing sections 32, 34, 36. For example, the first and second separators 80, 82 can downwardly extend from the ceiling 20 (from an inner surface thereof) to separate respectively an upper portion of the intermediate curing section from the upper portion of the upstream curing section and the upper portion of the intermediate curing section from an upper portion of the downstream curing section.

In one scenario, a length of the separators 80, 82 can be sufficient to allow the heated/humid air of the intermediate and downstream curing sections, which naturally circulates upwardly, to be directed, at least in part, through the inlets 70, 76 of the second and first recirculation ducts 68, 74, which can be located respectively in the upper portions of the intermediate and downstream curing sections. The first and second separators 80, 82 can thus help in preventing the heated/humid air of the intermediate and downstream curing sections 34, 36 from directly reaching respectively the upstream and intermediate curing sections 32, 34.

The first and second separators 80, 82 can be configured so as to allow the coated wood substrate 12 to be conveyed through the curing room 14 (i.e., are shaped and dimensioned to be spaced apart from the conveyor 30 so as not to hinder the displacement of the coated wood substrate along the displacement axis 26). The fans (not represented in the first embodiment) and separators 80, 82 can thus help in controlling temperature and more particularly, humidity, of the curing sections 32, 34, 36.

It is appreciated that the shape, the configuration, the location and/or the number of the room section separators can vary from the embodiment shown.

Possible Features and Parameters

While the curing sections 32, 34, 36 are shown in FIGS. 1 to 6 as being directly connected (i.e., the upstream curing section 32 is directly adjacent to the intermediate curing section 34, which is directly adjacent to the downstream curing section 36), it is noted that in other scenarios, the curing sections 32, 34, 36 can be separated by a certain distance.

In one implementation, the temperature of the first heated air stream or upstream heated air stream (i.e., the temperature of the upstream curing section 32) can thus be between about 10° C. and about 40° C., between about 15° C. and about 35° C., or between about 20° C. and about 30° C. The temperature of the second heated air stream or intermediate heated air stream (i.e., the temperature of the intermediate curing section 34) can be between about 10° C. and about 40° C., between about 15° C. and about 35° C., or between about 20° C. and about 30° C. Also, the temperature of the third heated air stream or downstream heated air stream (i.e., the temperature of the downstream curing section 36) can be between about 10° C. and about 40° C., between about 15° C. and about 35° C., or between about 20° C. and about 30° C. Since important amounts of water and/or solvent vapors can be expelled from the wet coating 13 during the first stage of the curing process (i.e., when the coated wood substrate 12 is conveyed through the upstream curing section 32 of the curing room 14 with the gas catalytic IR heaters 38*a*, 38*b*, 38*c*, 38*d* producing upstream IR radiation at the highest wavelength or highest radiation intensity), the temperature can be higher in the upstream curing section 32, and can decrease in the intermediate curing section 34 and the downstream curing section 36 of the curing room 14. Thus, it is noted that the temperature of the upstream curing section 32 can be higher than the temperature of the intermediate curing section 34, and that the temperature of the intermediate curing section 34 can be higher than the temperature of the downstream curing section 36. It is further noted that the temperature of the upstream, intermediate and downstream curing sections 32, 34, 36 can depend on the number of coated wood substrates 12 that are being conveyed through the curing room 14, on the ambient temperature, and on the radiation intensity of the gas catalytic IR heaters emitting IR radiation.

In one implementation, the water content of the upstream heated air stream can be between about 50% v/v and about 80% v/v, between about 55% v/v and about 75% v/v, or between about 60% v/v and about 70% v/v. In one implementation, the water content of the intermediate heated air stream can be between about 40% v/v and about 70% v/v, between about 45% v/v and about 65% v/v, or between about 50% v/v and about 60% v/v. In one implementation, the water content of the downstream heated air stream can be between about 30% v/v and about 60% v/v, between about 35% v/v and about 55% v/v, or between about 40% v/v and about 50% v/v. In some scenarios, the water content of the upstream heated air stream can be higher than the water content of the intermediate heated air stream, and the water content of the intermediate heated air stream can be higher than the water content of the downstream heated air stream. It is noted that the ventilation system 71 can take any shape, size or configuration, as long as it allows to recirculate the heated/humid air from one curing section to another, reducing the air flow rates at the exhausts of the curing room 14.

For example, air can flow through the curing sections 32, 34, 36 at a flow rate of between about 2,000 cfm. In one implementation, the airflow rate of the upstream heated air stream can be between about 600 cfm and about 1800 cfm, between about 700 cfm and about 1700 cfm, or between about 800 cfm and about 1600 cfm. The airflow rate of the intermediate heated air stream can be between about 200 cfm and about 1000 cfm, between about 300 cfm and about 900 cfm, or between about 400 cfm and about 800 cfm. The airflow rate of the downstream heated air stream can be between about 100 cfm and about 500 cfm, between about 200 cfm and about 400 cfm, or between about 250 cfm and about 350 cfm.

According to the configuration of the system 10, the residence time of the coated wood substrate 12 in the curing room 14 to produce the cured coated wood substrate 28 (i.e., the curing time of the wet coating 13) can be less than 15 minutes, less than 10 minutes, less than 8 minutes, less than 7 minutes, less than 6 minutes, less than 5 minutes, less than 4 minutes, less than 3 minutes, less than 2 minutes, or less than 1 minute. As mentioned above, the IR radiation is absorbed by the wet coating, rather than by the wood substrate itself, preventing the wood substrate from being damaged. It is noted that the curing time can vary depending on the thickness of the applied wet coating, the radiation intensity provided in the upstream, intermediate and downstream sections 32, 34, 36 of the curing room 14, the relative humidity surrounding the coated wood substrate, etc.

Figure 9:
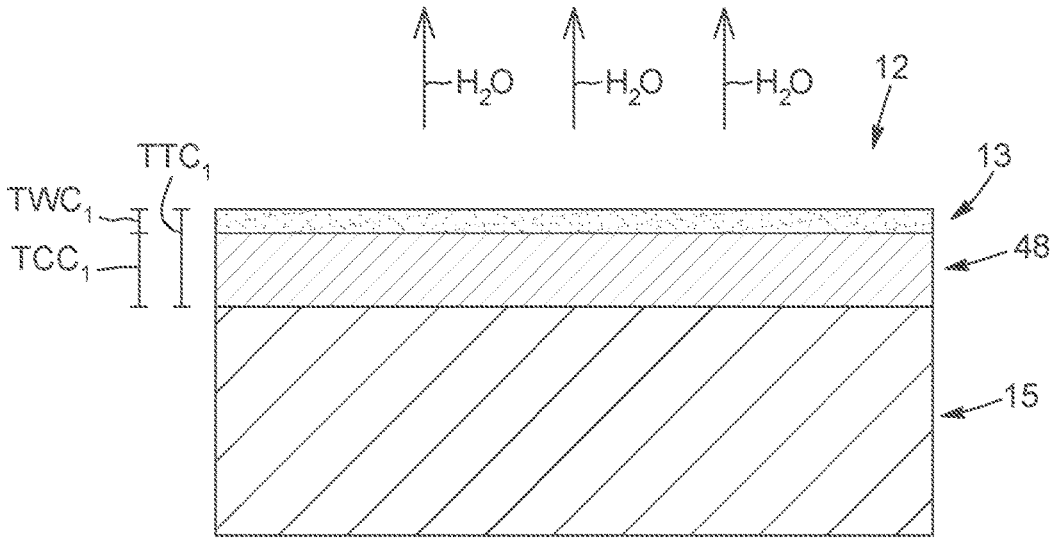
FIG. 9 is a schematic cross-section view of the coated substrate of FIG. 8 after it has passed through an upstream curing section of the curing room of the system of FIG. 1.

Referring now to the implementation of FIG. 9, once the partially cured coated wood substrate 12 has passed through the upstream curing section 32, the thickness of the cured coating TCC1 can be between about 50% and about 99%, between about 60% and about 90%, or between about 70% and about 85% of the total thickness of the coating TTC1 (i.e., TTC1=thickness cured coating TCC1+thickness wet coating TWC1).

Figure 10:
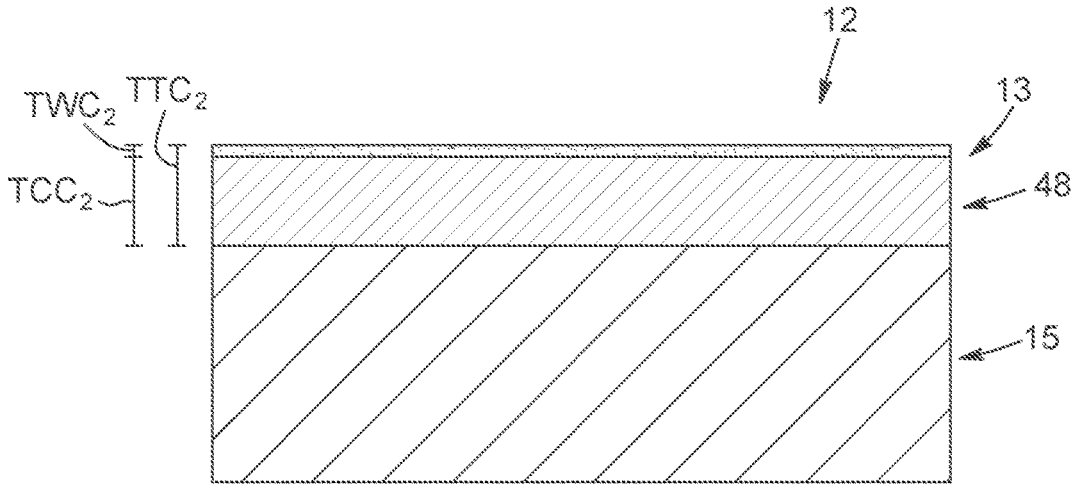
FIG. 10 is a schematic cross-section view of the coated substrate of FIG. 9 after it has passed through an intermediate curing section of the curing room of the system of FIG. 1.

Referring now to the implementation of FIG. 10, once the partially cured coated wood substrate 12 has passed through the intermediate curing section 34, the thickness of the cured coating TCC2 can be between about 51 and about 100%, between about 80% and about 99%, or between about 90% and about 98% of the total thickness of the coating TTC2 (i.e., TTC2=thickness cured coating TCC2+thickness wet coating TWC2).

Figure 11:
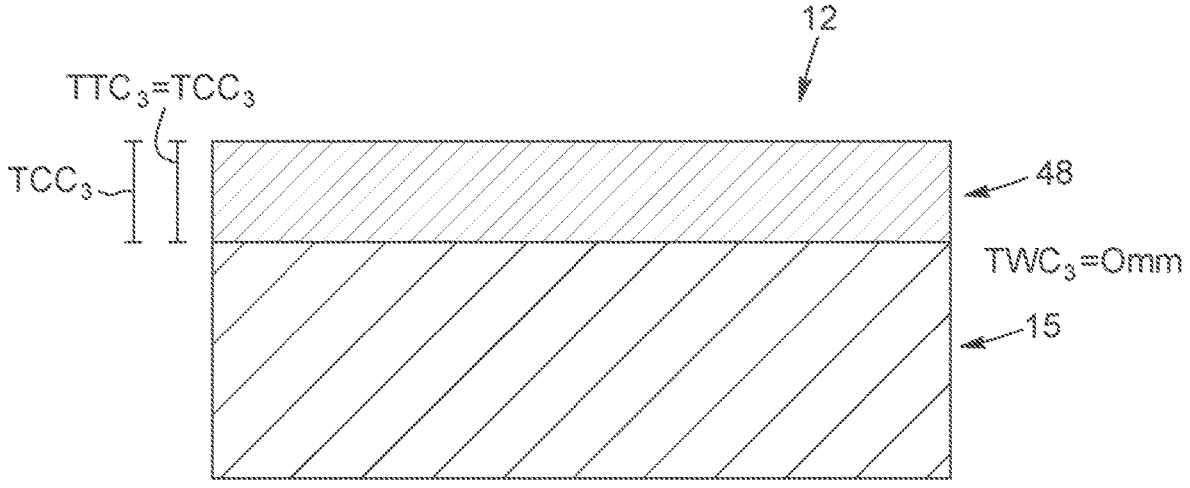
FIG. 11 is a schematic cross-section view of the coated substrate after it has passed through a downstream section of the curing room of the system of FIG. 1.

Referring now to the implementation of FIG. 11, once the coated wood substrate 12 has passed through the downstream curing section 36, the total thickness of the coating TTC3 equals the thickness of the cured coating TCC3. As shown in the implementations of FIGS. 3 to 6, the wet coating 13 heats and cures bottom up, until 100% of the thickness of the coating is cured.

In one implementation, the gas catalytic IR system can further include gas catalytic IR heater controllers or heating system controller assemblies 700, which can be operatively coupled to at least one of the catalytic heaters 38*a*, 38*b*, 38*c*, 38*d*, 40*a*, 40*b*, 40*c*, 40*d*, 42*a*, 42*b*, 42*c*, 42*d* to control the upstream, intermediate or downstream radiation intensity. Moreover, each gas catalytic IR heater or some of them can include a temperature sensing device 400 (FIG. 7) to measure the temperature of the wet coating or the temperature of the cured coating when being conveyed through the curing room 14. For example, the temperature sensing device 400 can be a pyrometer or any type of remote-sensing thermometer which can be used to measure the temperature of the wet coating or cured coating. For example, the temperature sensing devices 400 can be operatively coupled to the gas catalytic IR heater controllers or heating system controller assemblies 700, and the system 10 can further include a system controller 750, which can be operatively coupled to the gas catalytic IR heater controllers 700 and the temperature sensing devices 400, so as to control the gas catalytic IR heater controllers relative to measured temperatures of the wet coating at different locations in the curing room 14. Thus, if one of the upstream, intermediate, or downstream temperatures of the wet coating or cured coating measured by the temperature sensing devices 400 is too high or too low, the gas catalytic IR heater controllers 700 can control the gas catalytic IR heaters to reduce or increase the radiation intensity of the upstream, intermediate or downstream IR radiation. The temperature gradient experienced by the wet coating between the lower layer and the upper layer of the wet coating can also be sensed by the temperature sensing devices 400 and the system controller 750 can, via the gas catalytic IR heater controllers 700, adjust the IR radiation accordingly. It will be understood that in addition to temperature feedback provided by the temperature sensing devices 400, the control of the system 10 can involve parameters regarding the wood substrate (e.g., type, dimensions, distance from gas catalytic IR heaters, and wet coating nature and composition, etc.), conveyor speed. Humidity sensing devices can also be provided and operatively coupled to the system controller and ventilation system for controlling the ventilation system depending on the humidity present in the curing sections. For instance, the system controller 750 could be operatively coupled to valves arranged at inlets and/or outlets of the different ducts of the ventilation system and/or to the exhausts thereof.

It is appreciated that the shape and the configuration the curing system, as well as the shape, the configuration and the location of the different components thereof can vary from the embodiments shown.

Process Implementations

According to another aspect of the disclosure, there is provided a process for curing a wet coating of a coated substrate.

The process according to embodiments of the present disclosure may be carried out with a system as the ones described above.

Figure 13:
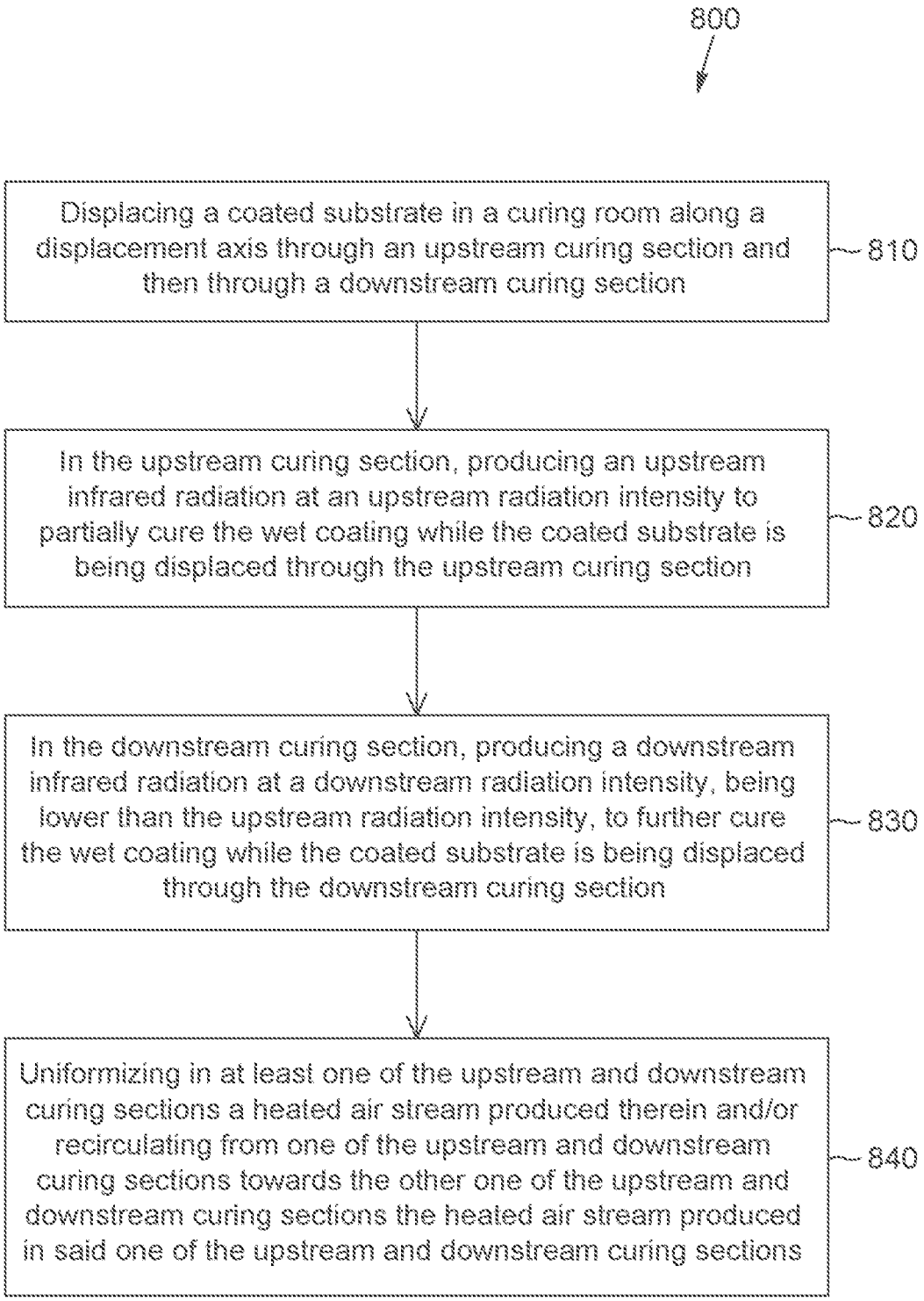
FIG. 13 is a block diagram representing the different steps of a process for curing a wet coating of a coated substrate.

As represented in FIG. 13, the process 800 comprises a step 810 of displacing the coated substrate in a curing room along a displacement axis through an upstream curing section and then through a downstream curing section; in the upstream curing section, a step 820 of producing an upstream infrared radiation at an upstream radiation intensity using an upstream gas catalytic infrared heating system to partially cure the wet coating while the coated substrate is being displaced through the upstream curing section; in the downstream curing section, a step 830 of producing a downstream infrared radiation at a downstream radiation intensity, being lower than the upstream radiation intensity, using a downstream gas catalytic infrared heating system to further cure the wet coating while the coated substrate is being displaced through the downstream curing section; and a step 840 of at least one of substantially uniformizing in at least one of the upstream and downstream curing sections a heated air stream produced therein and recirculating from one of the upstream and downstream curing sections towards the other one of the upstream and downstream curing sections a heated air stream produced in said one of the upstream and downstream curing sections.

The process 800 might further comprise a step of displacing the coated substrate through an intermediate curing section of the curing room before being displaced through the downstream curing section and a step of producing in the intermediate curing section an intermediate infrared radiation at an intermediate radiation intensity, being lower than the upstream radiation intensity and higher than the downstream radiation intensity, using an intermediate gas catalytic infrared heating system to further heat and partially cure the wet coating while the coated substrate is being displaced through the intermediate curing section.

In the embodiment shown wherein the system comprises a ventilation system, the process might further comprise a step of recirculating a downstream heated air stream produced in the downstream curing section towards the intermediate curing section and/or a step of recirculating an intermediated heated air stream produced in the intermediate curing section towards the upstream curing section.

In the embodiment wherein the system comprises a pre-curing room upstream the curing room, the process might further comprise a step of fluidly connecting a pre-curing room outlet to the curing room inlet in an airtight manner. The process might further comprise at least one of lowering an inner pressure of the pre-curing room, filtering ambient air prior it flows through the curing room via the pre-curing room and circulating a cool air from the pre-curing room directly towards the curing room outlet to cool the cured coated substrate.

In the present description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures or described in the present disclosure are embodiments only, given solely for exemplification purposes.

Moreover, components of the present system and/or steps of the process(es) described herein could be modified, simplified, altered, omitted and/or interchanged, without departing from the scope of the present disclosure, depending on the particular applications which the present system is intended for, and the desired end results, as briefly exemplified herein and as also apparent to a person skilled in the art.

In addition, although the embodiments as illustrated in the accompanying drawings comprise various components, and although the embodiments of the present system and corresponding portion(s)/part(s)/component(s) as shown consist of certain geometrical configurations, as explained and illustrated herein, not all of these components and geometries are essential and thus should not be taken in their restrictive sense, i.e. should not be taken so as to limit the scope of the present disclosure. It is to be understood, as also apparent to a person skilled in the art, that other suitable components and cooperation thereinbetween, as well as other suitable geometrical configurations may be used for the present system and corresponding portion(s)/part(s)/component(s) according to the present system, as will be briefly explained herein and as can be easily inferred herefrom by a person skilled in the art, without departing from the scope of the present disclosure.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

Although the present invention has been described hereinabove by way of specific embodiments thereof, it can be modified, without departing from the spirit and nature of the subject invention defined in the appended claims.

The invention claimed is:

1. A system for curing a wet coating of a coated substrate, the system comprising:

a curing room configured to receive the coated substrate being displaced along a displacement axis, the curing room being dividable along the displacement axis into at least:

an upstream curing section defining a curing inner volume and comprising at least one upstream catalytic infrared heater for producing an upstream infrared radiation at an upstream radiation intensity to partially cure the wet coating while the coated substrate is being displaced within the curing inner volume of the upstream curing section along the displacement axis; and a downstream curing section defining a curing inner volume and comprising at least one downstream catalytic infrared heater for producing a downstream infrared radiation at a downstream radiation intensity, being lower than the upstream radiation intensity, to further cure the wet coating while the coated substrate is being displaced within the curing inner volume of the downstream curing section along the displacement axis for producing a cured coating; and a ventilation system having:

an inlet at one of the upstream and downstream curing sections and opening into the curing inner volume of said one of the upstream and downstream curing sections;

an outlet at the other one of the upstream and downstream curing sections and opening into the curing inner volume of said other one of the upstream and downstream curing sections;

wherein the ventilation system recirculates from said one of the upstream and downstream curing sections towards the curing inner volume of the other one of the upstream and downstream curing sections the heated air stream produced in the curing inner volume of said one of the upstream and downstream curing sections upon curing of the wet coating via the corresponding one of the upstream and downstream infrared radiations.

2. The system of claim 1, wherein the curing room further comprises a curing room inlet and a curing room outlet spaced apart from each other, and a conveyor for conveying the coated substrate through the curing room from the curing room inlet towards the curing room outlet along the displacement axis, the system further comprising a pre-curing room upstream the curing room and comprising a pre-curing room outlet being fluidly connected to the curing room inlet in an airtight manner, wherein the pre-curing room comprises an air stream inlet for ambient air to flow therethrough and a filtering system at the air stream inlet to filter the ambient air, wherein a pressure within the pre-curing room is substantially null.

3. The system of claim 2, wherein the ventilation system comprises a cooling duct comprising a cooling duct inlet at the pre-curing room and a cooling duct outlet at the curing room outlet or in the vicinity thereof for cooling the cured coated substrate.

4. The system of claim 2, further comprising a wet coating spraying or brushing equipment upstream the pre-curing room, the pre-curing room, the curing room and the wet coating spraying or brushing equipment being configured in an ambient airtight manner so that the coated substrate can be provided to the curing room with no contact with the ambient air surrounding the curing room.

5. The system of claim 1, further comprising:

a heating system controller assembly operatively coupled to at least one of the at least one upstream catalytic infrared heater and the at least one downstream catalytic infrared heater to control the corresponding one of the upstream and downstream radiation intensities;

at least one of an upstream temperature sensing device and a downstream temperature sensing device respectively in the upstream and downstream curing sections to measure respectively upstream and downstream temperatures of the wet coating being displaced through the corresponding one of the upstream and downstream curing sections, said at least one of the upstream and downstream temperature sensing devices being operatively coupled to the heating system controller assembly; and a curing system controller operatively coupled to the heating system controller assembly and said at least one of the upstream and downstream temperature sensing devices for controlling the heating system controller assembly relative to measured values of the upstream and downstream temperatures.

6. The system of claim 1, wherein the ventilation system comprises at least one intrasection recirculation duct having an inlet and an outlet both at one of the upstream and downstream curing sections for uniformizing the heated air stream produced within the curing inner volume of the corresponding one of the upstream and downstream curing sections upon curing of the wet coating via the corresponding one of the upstream and downstream infrared radiations.

7. The system of claim 1, wherein the ventilation system comprises at least one intersection recirculation duct having an inlet opening into the curing inner volume of at the downstream curing section and an outlet opening into the curing inner volume of at the upstream curing section for recirculating the heated air stream produced in the downstream curing section upon curing of the wet coating via the downstream infrared radiation towards the curing inner volume of the upstream curing section.

8. The system of claim 1, wherein the ventilation system comprises an exhaust duct having an inlet at one of the upstream and downstream curing sections and an outlet for expelling air out of the curing room.

9. The system of claim 1, wherein the curing room is further dividable along the displacement axis into an intermediate curing section arranged between the upstream curing section and the downstream curing section, the intermediate curing section comprising at least one intermediate catalytic infrared heater for producing an intermediate infrared radiation at an intermediate radiation intensity, being lower than the upstream radiation intensity and higher than the downstream radiation intensity, to partially cure the wet coating while the coated substrate is being displaced through the intermediate curing section.

10. The system of claim 9, wherein the curing room further comprises at least a first separator to partially separate an upper portion of the upstream curing section from an upper portion of the intermediate curing section and a second separator to partially separate the upper portion of the intermediate curing section from an upper portion of the downstream curing section.

11. The system of claim 9, wherein the ventilation system comprises an intersection recirculation duct assembly having an inlet at the downstream curing section and an outlet at the upstream curing section for recirculating the heated air stream produced in the downstream curing section towards the upstream curing section, said intersection recirculation duct assembly comprising:

a first intersection recirculation duct having an inlet at the downstream curing section and an outlet at the intermediate curing section for recirculating the heated air stream produced in the downstream curing section towards the intermediate curing section; and a second intersection recirculation duct having an inlet at the intermediate curing section and an outlet at the upstream curing section for recirculating a heated air stream produced in the intermediate curing section towards the upstream curing section.

12. A process for curing a wet coating of a coated substrate, the process comprising:

displacing the coated substrate in a curing room along a displacement axis through an upstream curing section and then through a downstream curing section, the upstream curing section and the downstream section each defining a respective curing inner volume;

in the upstream curing section, producing an upstream infrared radiation at an upstream radiation intensity using an upstream catalytic infrared heater to partially cure the wet coating while the coated substrate is being displaced within the curing inner volume of the upstream curing section;

in the downstream curing section, producing a downstream infrared radiation at a downstream radiation intensity, being lower than the upstream radiation intensity, using a downstream catalytic infrared heater to further cure the wet coating while the coated substrate is being displaced within the curing inner volume of the downstream curing section; and via a ventilation system that includes an inlet at one of the upstream and downstream curing sections and that opens into the curing inner volume of said one of the upstream and downstream curing sections and an outlet at the other one of the upstream and downstream curing sections and that opens into the curing inner volume of said other one of the upstream and downstream curing sections, recirculating from said one of the upstream and downstream curing sections towards the curing inner volume of the other one of the upstream and downstream curing sections the heated air stream produced in said one of the upstream and downstream curing sections upon curing of the wet coating via the corresponding one of the upstream and downstream infrared radiations.

13. The process of claim 12, further comprising conveying the coated substrate through the curing room along the displacement axis from a curing room inlet towards a curing room outlet and wherein the coated substrate is further displaced through an intermediate curing section of the curing room after being displaced through the upstream curing section and before being displaced through the downstream curing section, the process further comprising, in the intermediate curing section, producing an intermediate infrared radiation at an intermediate radiation intensity, being lower than the upstream radiation intensity and higher than the downstream radiation intensity, using an intermediate catalytic infrared heater to further heat and partially cure the wet coating while the coated substrate is being displaced through the intermediate curing section, a heated air stream being produced in the intermediate curing section.

14. The process of claim 13, wherein the heated air stream produced in the downstream curing section is recirculated towards the intermediate curing section and/or the heated air stream produced in the intermediate curing section is recirculated towards the upstream curing section.

15. The process of claim 12, further comprising:

Providing a pre-curing room upstream the curing room;

Fluidly connecting a pre-curing room outlet to a curing room inlet of the curing room in an airtight manner airtight; and Lowering an inner pressure of the pre-curing room.

16. The process of claim 15, further comprising circulating a cool air from the pre-curing room directly towards a curing room outlet of the curing room to cool the cured coated substrate.

17. The process of claim 12, wherein a pressure gradient of the curing room is substantially null.

18. A system for curing a wet coating of a coated substrate, the system comprising:

a curing room configured to receive the coated substrate being displaced along a displacement axis, the curing room being dividable along the displacement axis into at least:

an upstream curing section defining a curing inner volume and comprising at least one upstream catalytic infrared heater for producing an upstream infrared radiation at an upstream radiation intensity to partially cure the wet coating while the coated substrate is being displaced within the curing inner volume of the upstream curing section along the displacement axis; and a downstream curing section defining a curing inner volume and comprising at least one downstream catalytic infrared heater for producing a downstream infrared radiation at a downstream radiation intensity, being lower than the upstream radiation intensity, to further cure the wet coating while the coated substrate is being displaced within the curing inner volume of the downstream curing section along the displacement axis for producing a cured coating; and a ventilation system having:

an inlet at the downstream curing section and opening into the curing inner volume thereof;

an outlet at the upstream curing section and opening into the curing inner volume thereof;

wherein the ventilation system recirculates from the curing inner volume of the downstream curing section towards the curing inner volume of the upstream curing section the heated air stream produced in the curing inner volume of the downstream curing section upon curing of the wet coating via the downstream infrared radiation.

19. A system for curing a wet coating of a coated substrate, the system comprising:

a curing room configured to receive the coated substrate being displaced along a displacement axis, the curing room being dividable along the displacement axis into at least:

an upstream curing section comprising at least one upstream catalytic infrared heater for producing an upstream infrared radiation at an upstream radiation intensity to partially cure the wet coating while the coated substrate is being displaced through the upstream curing section along the displacement axis;

a downstream curing section comprising at least one downstream catalytic infrared heater for producing a downstream infrared radiation at a downstream radiation intensity, being lower than the upstream radiation intensity, to further cure the wet coating while the coated substrate is being displaced through the downstream curing section along the displacement axis for producing a cured coating; and an intermediate curing section arranged between the upstream curing section and the downstream curing section, the intermediate curing section comprising at least one intermediate catalytic infrared heater for producing an intermediate infrared radiation at an intermediate radiation intensity, being lower than the upstream radiation intensity and higher than the downstream radiation intensity, to partially cure the wet coating while the coated substrate is being displaced through the intermediate curing section; and a ventilation system comprising an intersection recirculation duct assembly having an inlet at the downstream curing section and an outlet at the upstream curing section for recirculating the heated air stream produced in the downstream curing section upon curing of the wet coating via the downstream infrared radiation towards the upstream curing section, said intersection recirculation duct assembly comprising:

a first intersection recirculation duct having an inlet at the downstream curing section and an outlet at the intermediate curing section for recirculating the heated air stream produced in the downstream curing section towards the intermediate curing section; and a second intersection recirculation duct having an inlet at the intermediate curing section and an outlet at the upstream curing section for recirculating a heated air stream produced in the intermediate curing section upon curing of the wet coating via the intermediate infrared radiation towards the upstream curing section.

* * * * *